US010858770B2

(12) United States Patent
Shomura

(10) Patent No.: US 10,858,770 B2
(45) Date of Patent: Dec. 8, 2020

(54) OVERLOCK SEWING MACHINE

(71) Applicant: Janome Sewing Machine Co., Ltd., Tokyo (JP)

(72) Inventor: Eiichi Shomura, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 93 days.

(21) Appl. No.: 16/269,449

(22) Filed: Feb. 6, 2019

(65) Prior Publication Data

US 2019/0169774 A1 Jun. 6, 2019

Related U.S. Application Data

(63) Continuation of application No. PCT/JP2017/010284, filed on Mar. 14, 2017.

(30) Foreign Application Priority Data

Aug. 12, 2016 (JP) ..... 2016-158459

(51) Int. Cl.
*D05B 57/06* (2006.01)
*D05B 63/00* (2006.01)
(Continued)

(52) U.S. Cl.
CPC ..... *D05B 57/06* (2013.01); *D05B 63/00* (2013.01); *D05B 63/02* (2013.01); *D05B 63/04* (2013.01);
(Continued)

(58) Field of Classification Search
CPC ..... D05B 57/02; D05B 57/04; D05B 57/06; D05B 63/00; D05B 63/02; D05B 69/24;
(Continued)

(56) References Cited

U.S. PATENT DOCUMENTS 4,498,405 A * 2/1985 Hanyu ..... D05B 1/12 112/163
5,388,540 A * 2/1995 Satoma ..... D05B 77/00 112/261
(Continued)

FOREIGN PATENT DOCUMENTS

JP H5-070483 U 9/1993
JP H7-303784 A 11/1995
(Continued)

OTHER PUBLICATIONS

International Search Report issued in PCT/JP2017/010284 dated Jun. 13, 2017 with English Translation (6 pages).

*Primary Examiner* — Ismael Izaguirre
(74) *Attorney, Agent, or Firm* — Nakanishi IP Associates, LLC

(57) ABSTRACT

With a overlock sewing machine, when a switching mechanism is switched to a threading-enabled state, and a looper cover is closed, the looper cover is slid toward one side in the hinge shaft axial direction so as to operate a detection lever. In the non-operating state, the detection lever is set to an initial position where it does not press an operation protrusion of a switch. When a side cover is closed, and the detection lever is operated, the operation lever is set to an operation-enabled position where it presses the operation protrusion. When the operation lever is operated, and the side cover is opened, the detection lever is set by passing through the operation-enabled to the operation-disabled position where it does not press the operation protrusion.

6 Claims, 14 Drawing Sheets

(51) Int. Cl.

| | |
|---|---|
| ***D05B 63/02*** | (2006.01) |
| ***D05B 63/04*** | (2006.01) |
| ***D05B 69/36*** | (2006.01) |
| ***D05B 73/04*** | (2006.01) |
| ***D05B 87/02*** | (2006.01) |

(52) U.S. Cl.
CPC ..... *D05B 69/36* (2013.01); *D05B 73/04* (2013.01); *D05B 87/02* (2013.01)

(58) Field of Classification Search
CPC .. D05B 69/36; D05B 73/04–12; D05B 87/02; D05B 63/04
See application file for complete search history.

(56) References Cited

U.S. PATENT DOCUMENTS

| | | | |
|---|---|---|---|
| 9,290,872 | B2 | 3/2016 | Ishikawa |
| 9,347,163 | B2 | 5/2016 | Sakuma et al. |
| 2014/0190383 | A1 | 7/2014 | Ishikawa |
| 2015/0167218 | A1 | 6/2015 | Sakuma et al. |
| 2016/0215425 | A1 | 7/2016 | Shomura |

FOREIGN PATENT DOCUMENTS

| | | | |
|---|---|---|---|
| JP | H9-038369 | A | 2/1997 |
| JP | 2013-063221 | A | 4/2013 |
| JP | 2014-018292 | A | 2/2014 |
| JP | 2016-137028 | A | 8/2016 |

* cited by examiner

| | FRONT VIEW | ENGAGEMENT STATE OF MAIN SHAFT | POSITION OF JUDGMENT RING | LOOPER COVER | SIDE COVER | COMPONENTS AROUND SWITCH | MOTOR POWER SUPPLY |
|---|---|---|---|---|---|---|---|
| S1 | C | 60 69 68 | 72 76 | OPEN OR CLOSED STATE | OPEN OR CLOSED STATE | 76 84 | DISCONNECTION STATE |
| S2 | | | | OPEN STATE | OPEN OR CLOSED STATE | | DISCONNECTION STATE |
| S3 | | | | CLOSE STATE | OPEN STATE | | DISCONNECTION STATE |
| S4 | | | | CLOSE STATE | CLOSE STATE | | CONDUCTION STATE |

Fig.13

OVERLOCK SEWING MACHINE

CROSS-REFERENCE TO RELATED APPLICATIONS

This application is a continuation application of International Patent Application No. PCT/JP2017/010284 filed on Mar. 14, 2017, which claims priority to Japanese Patent Application No. 2016-158459 filed on Aug. 12, 2016, the entire contents of which are incorporated by reference.

BACKGROUND OF THE INVENTION

1. Field of the Invention

The present invention relates to an overlock sewing machine.

2. Description of the Related Art

A technique has been disclosed in Patent documents 1 and 2 listed below for an overlock sewing machine in which looper threading is supported by a pump driving operation, and a main shaft for sewing is driven by a single motor using clutch switching. This technique prevents abnormal switching in such an overlock sewing machine between the threading state and the sewing state. The technique is supported by providing separate respective switches, i.e., a switch used to detect the open/closed state of a looper cover or the like and a switch used to detect the switching between the looper threading state and the sewing-enabled state.

RELATED ART DOCUMENTS

Patent Documents

[Patent Document 1]
Japanese Patent Application Laid Open No. 2013-063221
[Patent Document 2]
Japanese Patent Application Laid Open No. 2014-018292

However, such an overlock sewing machine described in Patent documents 1 and 2 employs multiple switches. This involves complicated wiring, and leads to an increased cost. Furthermore, such an overlock sewing machine includes other kinds of covers such as a side cover or the like in addition to the looper cover.

SUMMARY OF THE INVENTION

In view of the above-described fact, it is a purpose of the present invention to provide an overlock sewing machine that requires only a single switch to detect the open/closed state of the looper cover and the side cover and to detect the threading switching state.

In order to address the aforementioned issue, a first embodiment of the present invention provides an overlock sewing machine comprising: a threading mechanism that performs threading for a looper; a switching mechanism that switches the threading mechanism between a threading state and a sewing-enabled state; a looper cover coupled with a hinge shaft extending in a width direction on a front side of the threading mechanism such that it can be opened and closed, and configured to cover at least a part of the looper at a closed position; a side cover provided on one side along the hinge shaft with respect to the looper cover, and coupled with a sewing machine main body such that it can be opened and closed; a switch configured including an operation protrusion, and configured such that, when the operation protrusion is pressed, a motor configured to drive a main shaft is switched from a driving-disabled state to a driving-enabled state; and a detection lever configured to press the operation protrusion, and configured such that, when the switching mechanism is switched to the sewing-enabled state in a state in which the looper cover is positioned at a closed state, the looper cover is slid toward one side in an axial direction of the hinge shaft, which operates the detection lever. In a non-operation state, the detection lever is positioned at an initial position at which it does not press the operation protrusion. When the detection lever is operated in a state in which the side cover is set to a closed position, the detection lever is set to an operation-enabled position at which the detection lever presses the operation protrusion. When the detection lever is operated in a state in which the side cover is set to an open position, the detection lever is set by passing through the operation-enabled position to an operation-disabled position at which the detection lever does not press the operation protrusion.

In order to address the aforementioned issue, a second embodiment of the present invention provides an overlock sewing machine according to the first embodiment. The overlock sewing machine comprises: a looper cover open/closed state detection shaft configured such that it extends in a direction in parallel with the hinge shaft, and such that, when it is moved toward one side along the hinge axis, it comes in contact with the detection lever so as to operate the detection lever; and a pressing portion provided to the looper cover, and configured such that, when the looper cover is slid toward the one side along the axial direction of the hinge shaft in a state in which the looper cover is set to the closed position, the pressing portion presses the looper cover open/closed state detection shaft. When the detection lever is operated in a state in which the side cover is set to the closed position, the side cover directly or otherwise indirectly operates the looper cover so as to provide positioning restriction of the pressing portion such that the detection lever is maintained at the operation-enabled position. When the detection lever is operated in a state in which the side cover is set to the open position, the side cover is located away from the looper cover such that the positioning restriction of the pressing portion is released, thereby setting the detection lever to the operation-disabled position.

In order to address the aforementioned issue, a third embodiment of the present invention provides an overlock sewing machine according to the second embodiment. The overlock sewing machine comprises: a detection lever spring that applies a force to the detection lever such that it is set to the initial position from the operation-enabled position or otherwise the operation-disabled position; a cover detection shaft spring that applies a force to the looper cover open/closed state detection shaft toward the other side in the axial direction; and a looper cover spring that applies a force to the looper cover such that the looper cover is moved toward the one side in the axial direction of the hinge shaft against the force applied by the cover detection shaft spring and the force applied by the detection lever spring in a state in which the looper cover is set to the closed position, so as to move the detection lever from the initial position to the operation-enabled position or otherwise to the operation-disabled position.

In order to address the aforementioned issue, a fourth embodiment of the present invention provides an overlock sewing machine according to any one the first embodiment through the third embodiment. The overlock sewing machine comprises: a swing lever portion configured to be swingable in a predetermined range such that, when rotation of the main shaft is enabled, the swing lever portion is positioned at an enabled position in a stationary state, and when the rotation of the main shaft is disabled, the swing lever portion is set to a swing position displaced from the enabled position; and an operation restricting portion configured such that, when the swing lever portion is set to the enabled position, the operation of the detection lever is enabled, and such that, when the swing lever portion is not set to the enabled position, the operation of the detection lever is restricted.

In order to address the aforementioned issue, a fifth embodiment of the present invention provides an overlock sewing machine according to any one the first embodiment through the fourth embodiment. In the overlock sewing machine, the switch is fixed to a sewing machine main body.

In order to address the aforementioned issue, a sixth embodiment of the present invention provides an overlock sewing machine according to any one the first embodiment through the fifth embodiment, further comprising a blade cover provided together with the looper cover such that the blade cover can be opened and closed, and configured to cover at least a part of a cutting mechanism configured to cut a sewing target. The blade cover is configured such that it can be moved in a direction along the axial direction of the hinge shaft independent of the looper cover according to a cutoff width adjustment amount set for the cutting mechanism.

Advantage of the Present Invention

With the overlock sewing machine having the above-described configuration, only a single switch is required to detect the open/closed states of the looper cover and the side cover and to detect the switching of the threading state.

BRIEF DESCRIPTION OF THE DRAWINGS

FIG. 13 is a table showing the operations of the principal components of the present embodiment in the form of a list.

DESCRIPTION OF THE PREFERRED EMBODIMENTS

Figure 1:
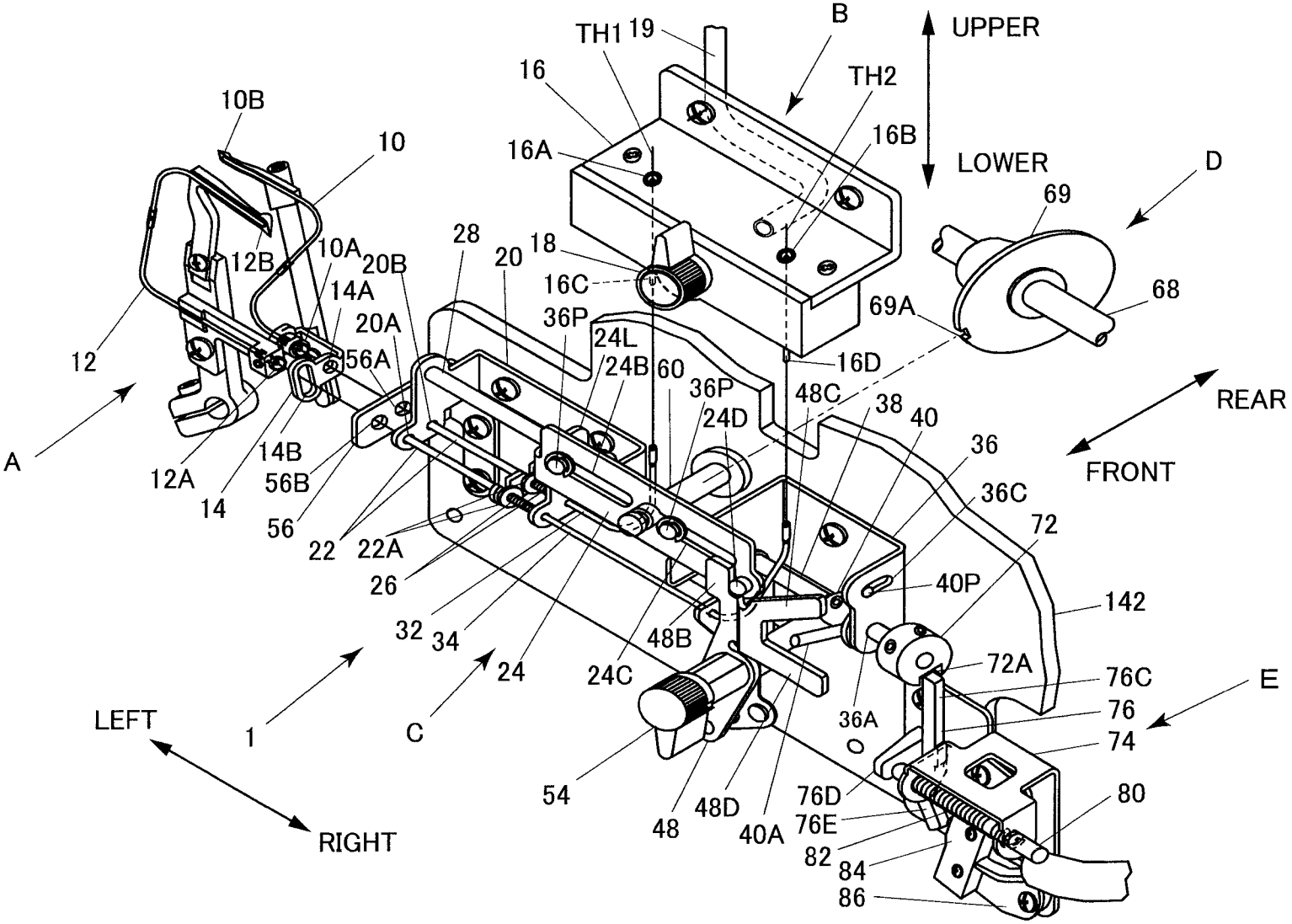
FIG. 1 is a perspective view showing principal components of an overlock sewing machine according to the present embodiment.

Description will be made with reference to the drawings regarding an overlock sewing machine 1 according to the present embodiment. It should be noted that the directions indicated by the arrows in the drawings as appropriate, i.e., the upper-lower direction, the front-back direction, and the left-right direction, respectively represent the upper and lower, front and back, and left and right (width) directions of the overlock sewing machine 1.

Figure 11:
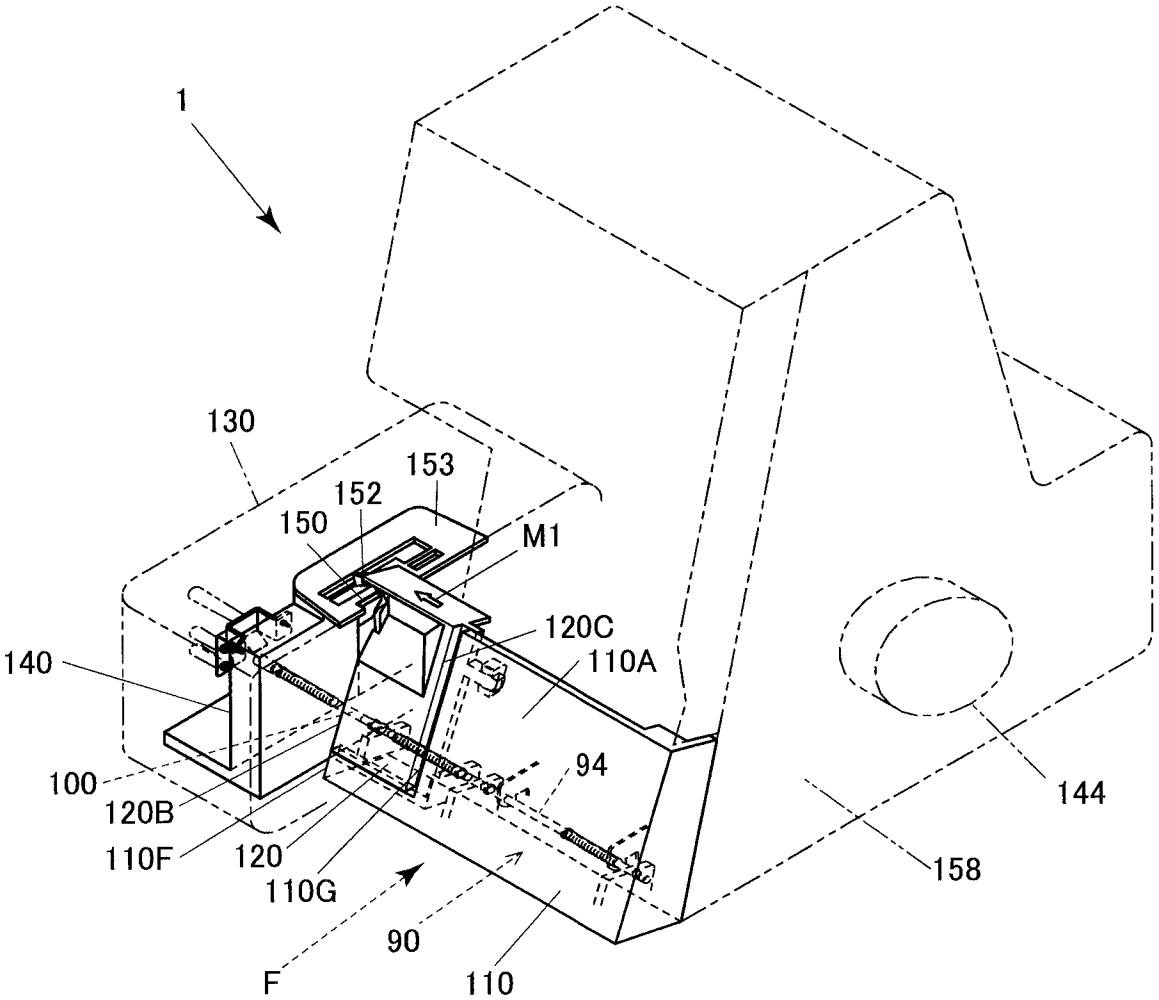
FIG. 11 is a diagram showing a state in which the cloth cutoff width to be set for the blades is set to its minimum.

As shown in FIG. 1, the overlock sewing machine 1 is configured including a looper unit A, an air flow path switching mechanism B, a threading switching mechanism C, a main shaft fixing mechanism D, and a safety mechanism E. Furthermore, as shown in FIG. 11, the overlock sewing machine 1 includes a looper cover 110 configured as a front portion of the overlock sewing machine 1 and configured to operate the safety mechanism E, a blade cover 120, and a side cover 130 that forms a left-side portion of the overlock sewing machine 1. Furthermore, the overlock sewing machine 1 includes a cover position switching mechanism F configured to switch the left-right position of the looper cover 110 in its closed state according to the open/closed state of the side cover 130. Moreover, in the overlock sewing machine 1, the air flow path switching mechanism B and the threading switching mechanism C form a "threading mechanism" configured to support looper threading using aerodynamic force. Furthermore, the threading switching mechanism C and the main shaft fixing mechanism D form a "switching mechanism" configured to switch the threading mechanism between the threading state and the sewing-enabled state. Description will be made regarding each of the mechanisms.

[Regarding Looper Unit A]

Figure 9:
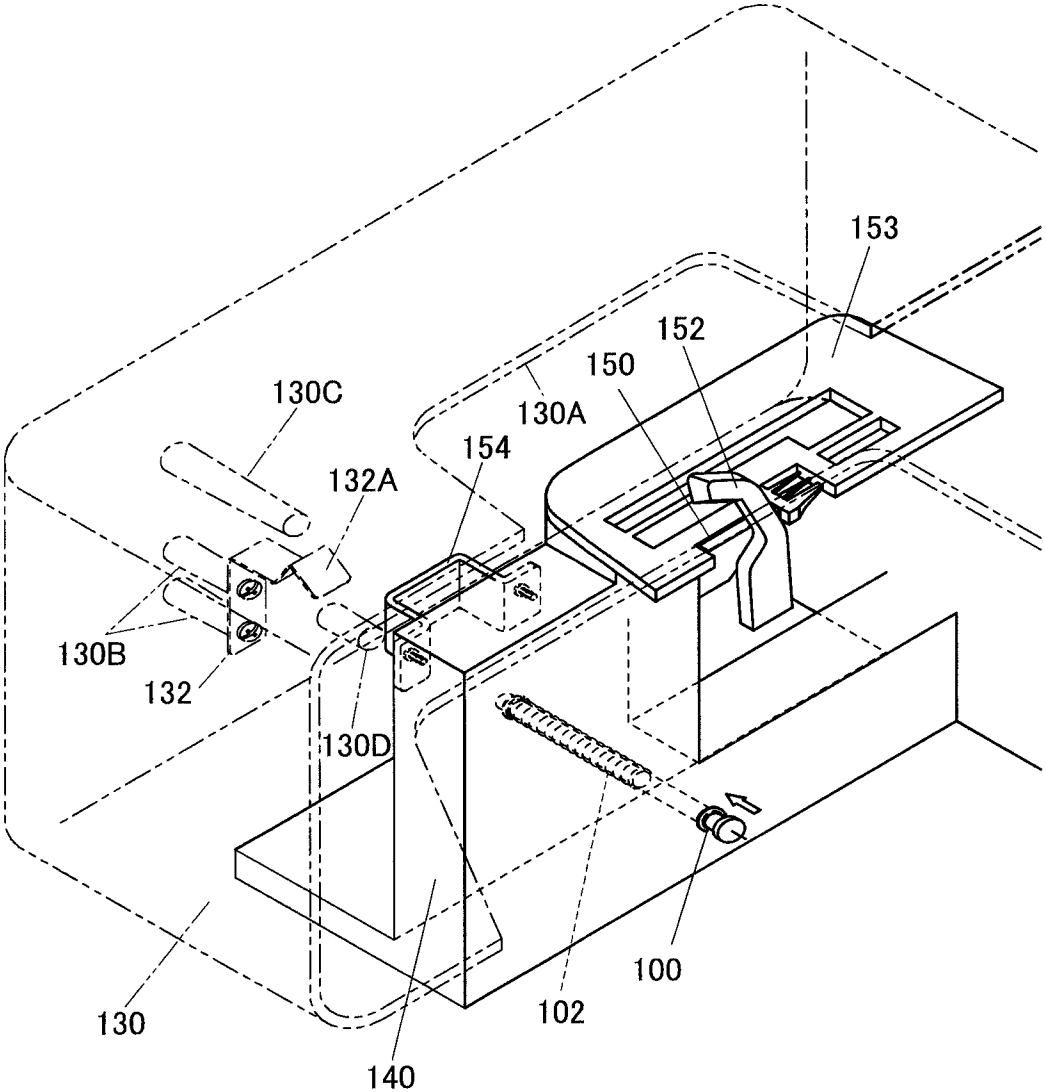
FIG. 9 is a perspective view showing the open state of the side cover.

As shown in FIG. 1, the looper unit A is arranged on the left side of a unit base 142 that forms part of a sewing machine main body 140 (see FIG. 9). The looper unit A includes an upper looper 10 and a lower looper 12 each of which is configured to have an approximately longitudinal and hollow structure. The upper looper 10 and the lower looper 12 have their end portions respectively configured as an upper looper inlet 10A and a lower looper inlet 12A, and have their tip portions respectively configured as an upper looper blade tip 10B and a lower looper blade tip 12B. The looper unit A is configured to allow the upper looper inlet 10A and the lower looper inlet 12A to receive an upper looper thread TH1 and a lower looper thread TH2 transferred via the air flow path switching mechanism B and the threading switching mechanism C. The looper unit A includes a looper balance 14. The looper balance 14 includes an upper looper thread hook 14A and a lower looper thread hook 14B. With such an arrangement, the upper looper 10 and the lower looper 12 are configured such that they are reciprocally driven such that they cross at an appropriate timing with a needle (not shown) driven in the upper-lower direction by the rotation of a main shaft 68 described later.

[Regarding Air Flow Path Switching Mechanism B]

As shown in FIG. 1, the air flow path switching mechanism B includes an approximately block-shaped main body 16. The main body 16 is fixed on the front side of the unit base 142. A tube 19 is arranged on the back face of the main body 16. The air flow path switching mechanism B is configured such that the compressed air generated by a compressed air supply apparatus (not shown) is supplied to the air flow path switching mechanism B via the tube 19. Furthermore, an upper looper thread insertion opening 16A and a lower looper thread insertion opening 16B are formed on the upper face of the main body 16. The upper looper thread insertion opening 16A and the lower looper thread insertion opening 16B are configured such that they respectively communicate with an upper looper thread discharging tube 16C and a lower looper thread discharging tube 16D. Furthermore, a selection knob 18 is provided on the front face of the main body 16. The air flow path switching mechanism B is configured to allow the user to operate the selection knob 18 to select the thread to be threaded from among the upper looper thread TH1 and the lower looper thread TH2.

[Regarding Threading Switching Mechanism C]

Figure 2:
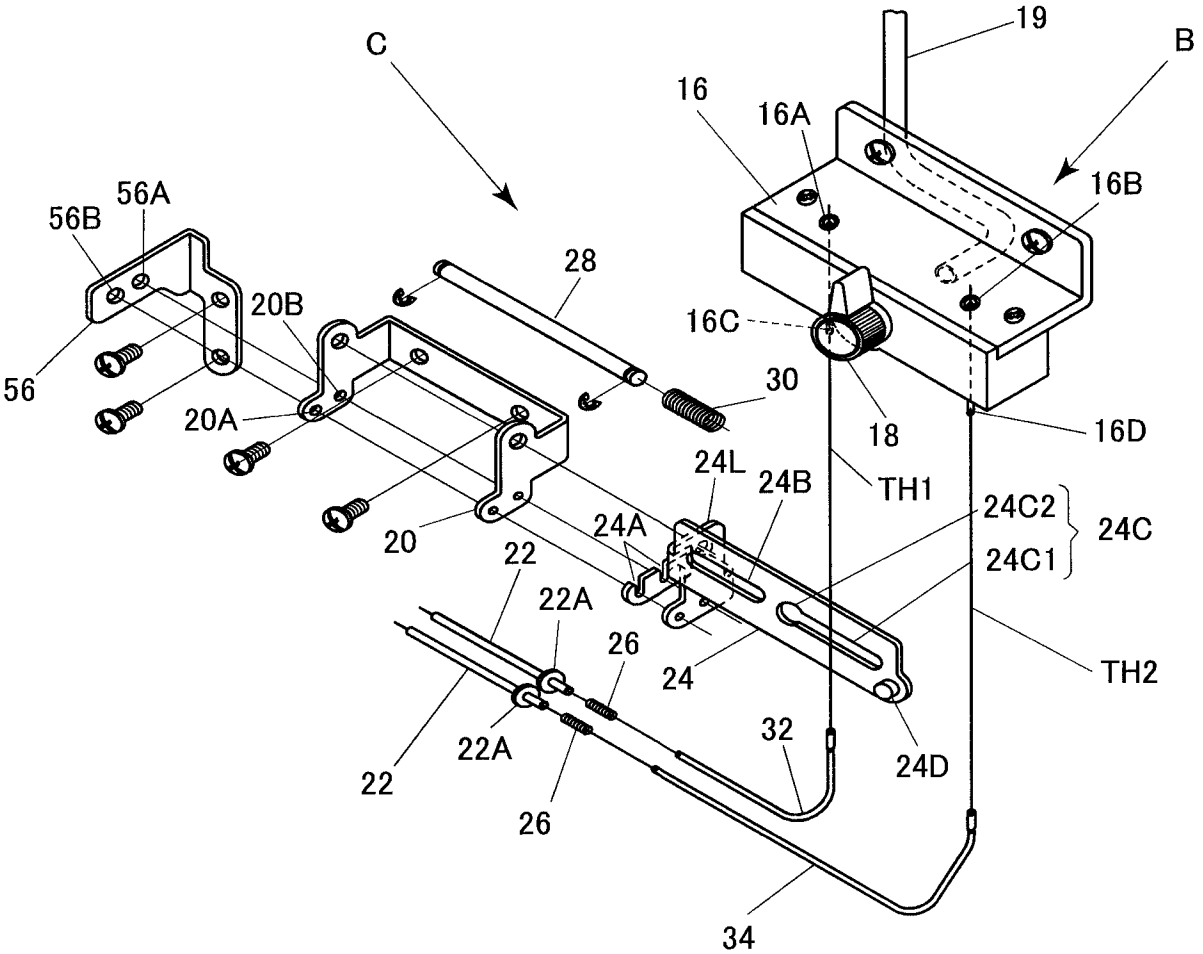
FIG. 2 is an exploded perspective view showing an air flow path switching mechanism and a threading switching mechanism.

As shown in FIG. 1, the threading switching mechanism C is arranged below the air flow path switching mechanism B. As also shown in FIG. 2, the threading switching mechanism C includes a tube support member 20. In a plan view as viewed from the top side, the tube support member 20 is configured to have an approximately U-shaped structure having an opening facing the front side. The tube support member 20 is fixedly mounted on the unit base 142 (see FIG. 1) by screws. Furthermore, the threading switching mechanism C includes a pair of slide tubes 22 arranged in parallel in the front-back direction, each extending in the left-right direction. The left-end portions of the slide tubes 22 are respectively slidably inserted into support holes 20A and 20B formed in the left-side wall of the tube support member 20. Furthermore, an upper looper conducting tube 32 and a lower looper conducting tube 34, each of which has an approximately inverted-L-shaped structure as viewed from the front side, are slidably inserted into the right ends of the respective slide tubes 22. The left-side ends of the upper looper conducting tube 32 and the lower looper conducting tube 34 are held by the right-side wall of the tube support member 20. Furthermore, the upper-end portions of the upper looper conducting tube 32 and the lower looper conducting tube 34 are coupled to the upper looper thread discharging tube 16C and the lower looper thread discharging tube 16D, respectively. Furthermore, a flange 22A is formed on the right-side end of each slide tube 22.

A slide plate (slide member) 24 is arranged on the right side of the tube support member 20 such that its thickness direction matches the front-back direction and such that it extends in the left-right direction. The slide plate 24 has a left-side end portion configured as a holding portion 24L. In a plan view, the holding portion 24L is configured to have an approximately U-shaped structure having an opening facing the front side. The holding portion 24L is arranged within a space defined by the tube support member 20. With such an arrangement, the slide tubes 22 are slidably held by U-shaped groves 24A formed in the holding portion 24L. Furthermore, the flange 22A of each slide tube 22 is arranged on the inner side of the holding portion 24L. Furthermore, a slide tube spring 26 configured as a compression coil spring is mounted on the right-end portion of each slide tube 22. Each slide tube spring 26 is arranged between the flange 22A and the right wall of the holding portion 24L. This allows each slide tube 22 to be moved between the threading position and the sewing-enabled position according to the sliding of the slide plate 24 in the left-right direction. Specifically, with this arrangement, at the threading position, the left ends of the slide tubes 22 are respectively coupled to the upper looper inlet 10A and the lower looper inlet 12A. At the sewing-enabled position, the left ends of the slide tubes 22 are moved toward the right side away from the upper looper inlet 10A and the lower looper inlet 12A.

Furthermore, a slot 24B and an irregularly shaped slot 24C are formed in the slide plate 24 such that they have their longitudinal axes in the left-right direction and such that they are arranged in parallel along the left-right direction. Specifically, the irregularly shaped slot 24C is arranged on the right side of the slot 24B. Furthermore, the irregularly shaped slot 24C is configured to have a slot portion 24C1 having a constant width and an approximately circular expended-diameter portion 24C2 coupled to the left-side end of the slot portion 24C1 and having a diameter that is larger than the width of the slot portion 24C1. Furthermore, a pin 24D is monolithically provided to the right-side end of the slide plate 24 so as to form a single unit such that it protrudes toward the front side.

A support shaft 28 is arranged above the aforementioned slide tubes 22 such that its axis extends in the left-right direction and such that it passes through both the left wall and the right wall of the tube support member 20. Furthermore, the support shaft 28 is arranged such that it passes through the holding portion 24L. In this state, the holding portion 24L is held so as to be slidable along the support shaft 28. Furthermore, a shaft spring 30 (see FIG. 2) configured as a compression coil spring is mounted on the right-side portion of the support shaft 28. The shaft spring 30 applies a force to the holding portion 24L of the slide plate 24 toward the left side with respect to the tube support member 20.

Figure 3A:
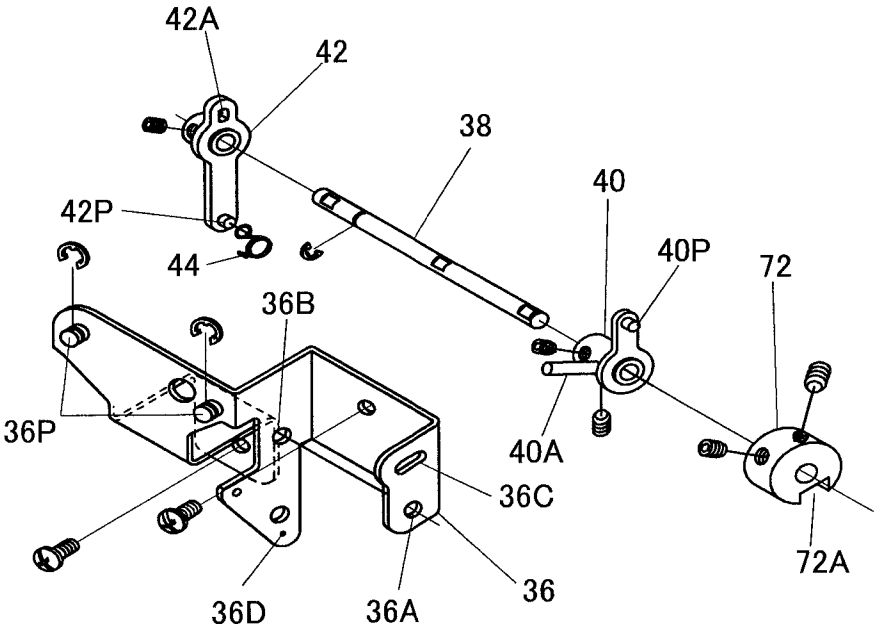
FIG. 3A is an exploded perspective view showing the components around a slide plate support of the threading switching mechanism.

As shown in FIG. 1, a slide plate support 36 is provided on the right side of the tube support member 20 and on the back side of the slide plate 24. The slide plate support 36 is fixed to the unit base 142 by screws. As also shown in FIG. 3A, the slide plate support 36 is configured to have an approximately longitudinal plate structure extending in the left-right direction. The right-side portion of the slide plate support 36 is configured to have an approximately U-shaped structure having an opening facing the front side as viewed in a plan view.

A pair of left and right pins 36P are provided to the left-side portion of the slide plate support 36 such that they protrude toward the front side. The pair of pins 36P are respectively inserted into the slot 24B and the slot portion 24C1 of the slide plate 24 such that the slide plate 24 is slidable. An operation shaft 38 is arranged such that its axis extends in the left-right direction and such that it passes through the right-side portion (U-shaped curved portion) of the slide plate support 36. Specifically, the operation shaft 38 is arranged such that it passes through through holes 36A and 36B formed in the slide plate support 36. As a result, the operation shaft 38 is rotatably held by the slide plate support 36.

Figure 3B:
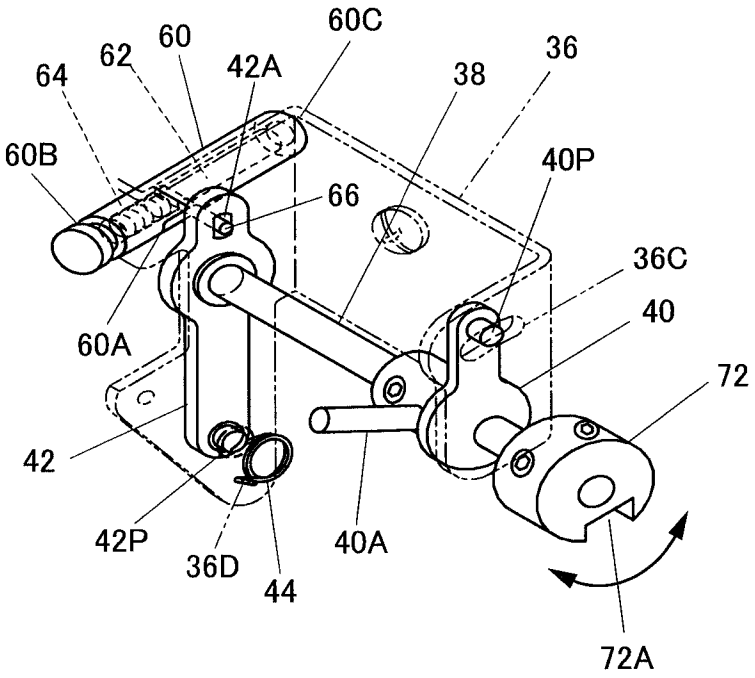
FIG. 3B is a perspective view showing the configuration on the right side of the slide plate support as viewed in a transparent view.

As shown in FIGS. 3A and 3B, a switching member (switching restricting portion) 40 is fixed to the operation shaft 38 on the left side with respect to the right wall of the slide plate support 36 so as to be swingable (turnable) together with the operation shaft 38. An arm is formed at the right-end portion of the switching member 40 such that it extends toward the upper side. Furthermore, a pin 40P is provided to the tip of the arm such that it protrudes toward the right side. The pin 40P is inserted into an arc-shaped curved slot 36C formed in the right wall of the slide plate support 36 so as to be slidable. Furthermore, the switching member 40 has an engagement pin 40A extending toward the front side.

A switching operation member (main shaft fixing operation arm portion) 42 is fixed to the operation shaft 38 on the right side with respect to the central side wall of the slide plate 36 so as to be swingable (turnable) together with the operation shaft 38. The switching operation member 42 has an arm extending toward the lower side. A pin 42P is provided to the tip of the arm such that it protrudes toward the right side. One end of an operation spring 44 configured as a torsion spring is engaged with the pin 42P. The other end of the operation spring 44 is engaged with a small hole 36D formed in the slide plate support 36. With such an arrangement, by the operation of the operation spring 44, a force is applied to the switching operation member 42 toward the front side or otherwise the back side with a neutral position (position shown in FIG. 3B) as a boundary. Furthermore, an engagement slot 42A is formed as a through hole in the upper-end portion of the switching operation member 42 such that its longitudinal direction matches the upper-lower direction.

Figure 4:
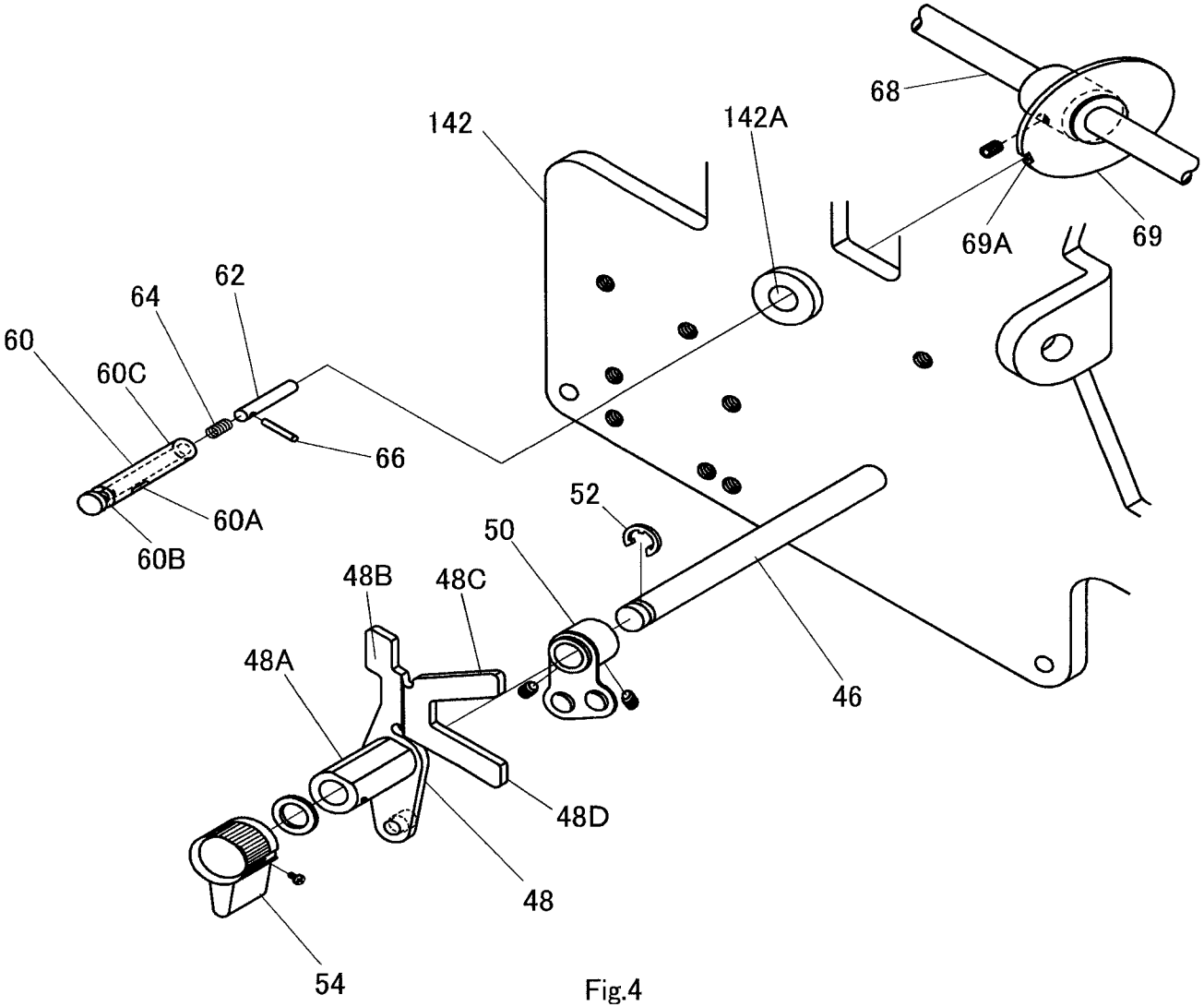
FIG. 4 is an exploded perspective view showing the components around a main shaft fixing mechanism and a switching linkage member of the threading switching mechanism.

As shown in FIG. 1, the switching linkage member 48 is provided on the front side of the slide plate support 36. As shown in FIG. 4, the switching linkage member 48 has a boss 48A having an approximately cylindrical shape. The boss 48A is rotatably supported by a support shaft 46 fixed to the unit base 142 such that its axis extends along the front-back direction. With such an arrangement, the switching linkage member 48 is interposed in the front-back direction between a reception member 50 fixed to the support shaft 46 and an E-ring 52 engaged with the support shaft 46.

The switching linkage member 48 includes a switching arm (slide member engagement portion) 48B and a pair of engagement arms (switching engagement portions) 48C and 48D. The switching arm 48B is provided such that it extends from the boss 48A toward the upper side. The tip of the switching arm 48B is arranged adjacent to the left side of the pin 24D (see FIG. 1) of the slide plate 24 described above. The engagement arm 48C is provided such that it extends from an intermediate portion in the longitudinal direction of the switching arm 48B in an approximately diagonally upper-right direction. Furthermore, the engagement arm 48D is provided at a position below the engagement arm 48C such that it extends from an intermediate portion in the longitudinal direction of the switching arm 48B toward the right side. Moreover, the engagement pin 40A (see FIG. 1) of the switching member 40 described above is arranged between the pair of engagement arms 48C and 48D.

Furthermore, a switching knob (switching operation portion) 54 is fixed to the boss 48A of the switching engagement member 48 such that it and the boss 48A can be swung (turned) as a single unit. With such an arrangement, upon turning the switching knob 54 around the axis of the support shaft 46 in the clockwise direction, the switching arm 48B presses the pin 24D of the slide plate 24 toward the right side, thereby sliding the slide plate 24 toward the right side. It should be noted that, with the overlock sewing machine 1, the switching knob 54 is arranged on the front side of a front cover 146 (see FIG. 6) described later so as to allow the user to operate the switching knob 54. Furthermore, as shown in FIG. 1, a looper balance guide 56 is arranged at the left end of the threading switching mechanism C. The looper balance guide 56 is fixed to the sewing machine main body 140 (described later) or the unit base 142. A pair of round holes 56A and 56B are formed in the looper balance guide 56 such that their positions correspond to the support holes 20A and 20B of the tube support member 20.

[Regarding Main Shaft Fixing Mechanism D]

As shown in FIG. 4, the main shaft fixing mechanism D includes an approximately cylindrical-shaped outer-side fixing shaft (first shaft) 60 having a bottom face and an opening facing the back side with its axial direction as the front-back direction. The outer-side fixing shaft 60 is inserted into an insertion hole 142A formed in the unit base 142. An internal-side fixing shaft (second shaft) 62 is inserted into the internal space of the outer-side fixing shaft 60 such that they can be moved relative to each other. Furthermore, a shaft spring 64 configured as a compression coil spring is inserted into the internal space of the outer-side fixing shaft 60 such that it is interposed between the bottom portion (front-end portion) of the outer-side fixing shaft 60 and the inner-side fixing shaft 62. The shaft spring 64 applies a force so as to move the outer-side fixing shaft 60 and the inner-side fixing shaft 62 away from each other in opposite directions.

As also shown in FIG. 3B, a coupling pin 66 is fixed to the front end of the inner-side fixing shaft 62. The coupling pin 66 is arranged such that it extends from the inner-side fixing shaft 62 toward the right side, and such that it is inserted into a slot (engagement portion) 60A formed such that it extends in the front-back direction in the outer circumferential portion of the outer-side fixing shaft 60. With this arrangement, the coupling pin 66 is engaged with the back end of the slot 60A by the force applied by the shaft spring 64. In this state, the relative position between the inner-side fixing shaft 62 and the outer-side fixing shaft 60 is maintained. On the other hand, the right end of the coupling pin 66 is inserted into the engagement slot 42A of the switching operation member 42 described above (see FIG. 3B). With this arrangement, the inner-side fixing shaft 62 is coupled to the switching operation member 42 by the coupling pin 66. By swinging the switching operation member 42, this arrangement allows the inner-side fixing shaft 62 and the coupling pin 66 to be moved in the front-back direction.

With the slide plate 24 at the sewing-enabled position described above, the outer-side fixing shaft 60 is positioned within the expanded-diameter portion 24C2 of the slide plate 24. Furthermore, a groove portion 60B is formed over the overall circumference of the outer circumferential portion of the front end of the outer-side fixing shaft 60. The inner edge of the slot 24C1 of the slide plate 24 is inserted into the groove portion 60B so as to allow the slide plate 24 to be slid toward the left side. This arrangement allows the slide plate 24 to be slid to the threading position.

As shown in FIG. 1, the main shaft 68 is arranged on the back side of the outer-side fixing shaft 60 such that its axis extends in the left-right direction. The main shaft 68 is configured such that it can be rotated by rotationally driving a flywheel 144 (see FIG. 11) provided on the right-side portion of the overlock sewing machine 1. An approximately disk-shaped main shaft fixing plate 69 is fixed to the main shaft 68. The main shaft fixing plate 69 is arranged such that it is aligned with the axial line of the outer-side fixing shaft 60. A notch 69A is formed in the outer-circumferential portion of the main shaft fixing plate 69 such that it has an opening facing the outer side along the radial direction of the main shaft fixing plate 69. By moving the outer-side fixing shaft 60 toward the back side such that the rear end 60C (see FIG. 4) of the outer-side fixing shaft 60 is fitted into the notch 69A, this arrangement prevents the rotation of the main shaft 68.

[Regarding Safety Mechanism E]

As shown in FIG. 1, the safety mechanism E is arranged on the right side with respect to the threading switching mechanism C described above. The safety mechanism E is configured including a judgment ring 72, a cover detection base 74, a detection lever 76, a looper cover open/closed state detection shaft 80 (which will simply be referred to as the "cover detection shaft 80" hereafter), a switch 84, and a switch base 86.

As shown in FIG. 3B, the judgment ring 72 is configured to have an approximately cylindrical shape. Furthermore, the judgment ring 72 is fixed to the operation shaft 38 such that it can be rotated together with the operation shaft 38 as a single unit on the right side of the slide plate support 36. A notch 72A is formed in the outer circumferential portion of the judgment ring 72 such that it has an opening facing the outer side in the radial direction of the judgment ring 72. The notch 72A is formed to have an opening that passes through in the axial direction of the judgment ring 72. With this arrangement, by turning the judgment ring 72 together with the operation shaft 38 as a single unit, this changes the turn position of the notch 72A, thereby controlling the operation of the detection lever 76 (allowing or restricting the operation of the detection lever 76). That is to say, depending on the swing position of the operation shaft 38, the judgment ring 72 and a first lever portion 76C of the detection lever 76 function as an operation restricting portion which restricts the operation of the detection lever 76. It should be noted that, in the present embodiment, the operation shaft 38, the switching member 40, the switching operation member 42, and the judgment ring 72 form the swing lever portion. Also, a part of or otherwise all of the components may be monolithically formed as a single unit so as to form such a swing lever portion.

Figure 5:
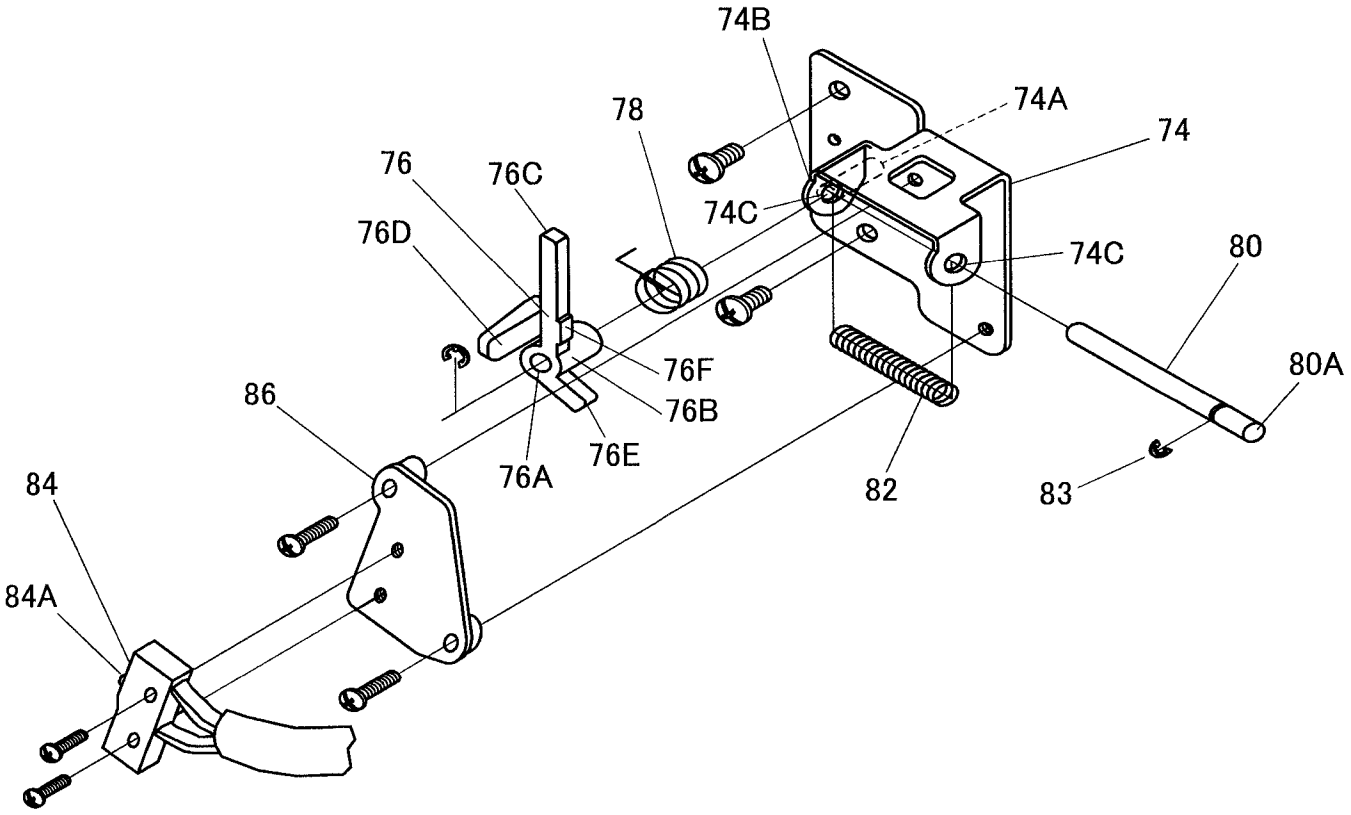
FIG. 5 is an exploded perspective view showing a safety mechanism.

As shown in FIG. 5, the cover detection base 74 is arranged on a diagonally lower-right side of the judgment ring 72 (see FIG. 1), and is fixed to the unit base 142 by screws. A support shaft 74A is provided to an approximately central portion of the cover detection base 74 such that it protrudes toward the front side.

The detection lever 76 has a cylindrical-shaped boss 76B having a support hole 76A in its central portion. The support shaft 74A of the cover detection base 74 is inserted into the support hole 76A so as to support the boss 76B (detection lever 76) such that it is turnable (swingable) around the support shaft 74A. That is to say, the turn axis of the detection lever 76 crosses the axis (left-right direction) of the operation shaft 38 described above. Furthermore, a detection lever spring 78 configured as a torsion spring is mounted on the rear-end portion of the boss 76B. The detection lever spring 78 applies a force to the detection lever 76 in the clockwise direction as viewed from the front side.

Furthermore, the detection lever 76 includes a first lever portion 76C extending toward the upper side from the boss 76B, an operation arm 76D extending toward the front side from the left-side face of an intermediate portion in the longitudinal direction of the first lever portion 76C, a second lever portion 76E extending from the boss 76B toward a diagonally lower-right side so as to press an operation protrusion 84A of a switch 84 described later, and a stopper 76F formed in an intermediate portion in the longitudinal direction of the first lever portion 76C such that it protrudes toward the right side.

With such an arrangement, in the sewing-enabled state of the threading switching mechanism C, the notch 72A of the aforementioned judgment ring 72 is positioned on the left side (enabled position) of the first lever portion 76C. In this state, the judgment ring 72 does not restrict the swinging of the first lever portion 76C toward the left side (the detection lever 76 is set to the operation enabled state). In contrast, in the threading state of the threading switching mechanism C, the notch 72A of the judgment ring 72 is displaced in the circumferential direction of the judgment ring 72 with respect to the tip portion of the first lever portion 76C (set to the swing position). In this state, the judgment ring 72 restricts the swinging of the first lever portion 76C toward the left side (the detection lever 76 is set to the operation restricted state).

It should be noted that, in the non-operating state of the detection lever 76, the stopper 76F of the detection lever 76 is pressed in contact with a left-side arm 74B of the cover detection base 74 by the force applied by the detection lever spring 78, thereby maintaining the detection lever 76 at its initial position.

The cover detection shaft 80 is arranged adjacent to the right side of the operation arm 76D of the detection lever 76 such that the axial direction of the cover detection shaft 80 extends along the left-right direction (see FIG. 1). Furthermore, the cover detection shaft 80 is inserted into a pair of through holes 74C formed in the cover detection base 74 so as to be slidable. Furthermore, a force-applying spring 82 (cover detection shaft spring) configured as a compression coil spring is mounted on the left-side portion of the cover detection shaft 80. The right end of the force-applying spring 82 is engaged with an E-ring 83 fixed to the cover detection shaft 80. The force-applying spring 82 applies a force to the cover detection shaft 80 toward the right side (in a direction away from the detection lever 76). With such an arrangement, when the cover detection shaft 80 is moved toward the left side against the force applied by the force-applying spring 82 so as to press the operation arm 76D of the detection lever 76 toward the left side, the detection lever 76 operates (swings around the axis of the support shaft 74A).

The switch 84 is arranged on the right side of the detection lever 76 (second lever portion 76E), and is fixed to the switch base 86 described later by screws. The switch includes an operation protrusion 84A. With this arrangement, when the detection lever 76 operates such that the second lever portion 76E presses the operation protrusion 84A, the switch 84 operates. Specifically, when the operation protrusion 84A is pressed by the detection lever 76 (second lever portion 76E) such that it retracts, the switch 84 is set to the on state, and the motor is set to a state in which driving is enabled. Conversely, when the operation protrusion 84A is not pressed by the detection lever 76 (second lever portion 76E) and it protrudes, the switch 84 is set to the off state, and the motor is set to a state in which driving is disabled.

The switch base 86 is formed of an insulating material, and is fixed to the cover detection base 74 by screws. Accordingly, the aforementioned switch 84 is fixed to the unit base 142 via the cover detection base 74. Accordingly, the switch 84 is fixed to a member that is stationary when the looper cover 110 or the side cover 130 described later is opened or closed. It should be noted that, in a case in which an insulation state is secured for the switch 84 and a terminal thereof, such a switch base 86 may be omitted.

With such an arrangement, at the initial position of the detection lever 76, the second lever portion 76E (the tip thereof) of the detection lever 76 retracts (has a distance)

with respect to the operation protrusion 84A of the switch 84 toward the lower side (non-operating range). That is to say, the motor is set to the driving-disabled state. Furthermore, the detection lever 76 is designed to provide two functions that are switched according to the pressing amount applied to the detection lever 76 by the cover detection shaft 80.

Specifically, the detection lever 76 is designed such that, when the pressing amount applied to the detection lever 76 by the cover detection shaft 80 matches a predetermined amount, the detection lever 76 rotates from the initial position in a counterclockwise direction around the axis of the support shaft 74A such that it is moved (driven) to an operation-enabled position at which the second lever portion 76E presses the operation protrusion 84A of the switch 84. With this arrangement, at the operation-enabled position of the detection lever 76, the motor comes to be in a state in which it can be driven. When the pressing amount applied to the detection lever 76 by the cover detection shaft 80 is larger than the predetermined amount, the detection lever 76 further rotates beyond the operation-enabled position. At this position, the second lever portion 76E is positioned away from the operation protrusion 84A (this position will be referred to as the "operation-disabled position" hereafter). With this arrangement, when the detection lever 76 is set to the operation-disabled position, the motor comes to be in a state in which it cannot be driven.

It should be noted that, with this arrangement, when the pressing force applied to the detection lever 76 by the cover detection shaft 80 is released, the detection lever 76 is turned (returned) to the initial position from the operation-enabled position or otherwise the operation-disabled position by the force applied by the detection lever spring 78.

[Regarding Looper Cover, Blade Cover, Side Cover, Cover Position Switching Mechanism F]

Next, description will be made regarding each of the components, i.e., the looper cover 110, the blade cover 120, and the side cover 130, while describing the cover position switching mechanism F which is a principal component of the present invention.

Figure 6:
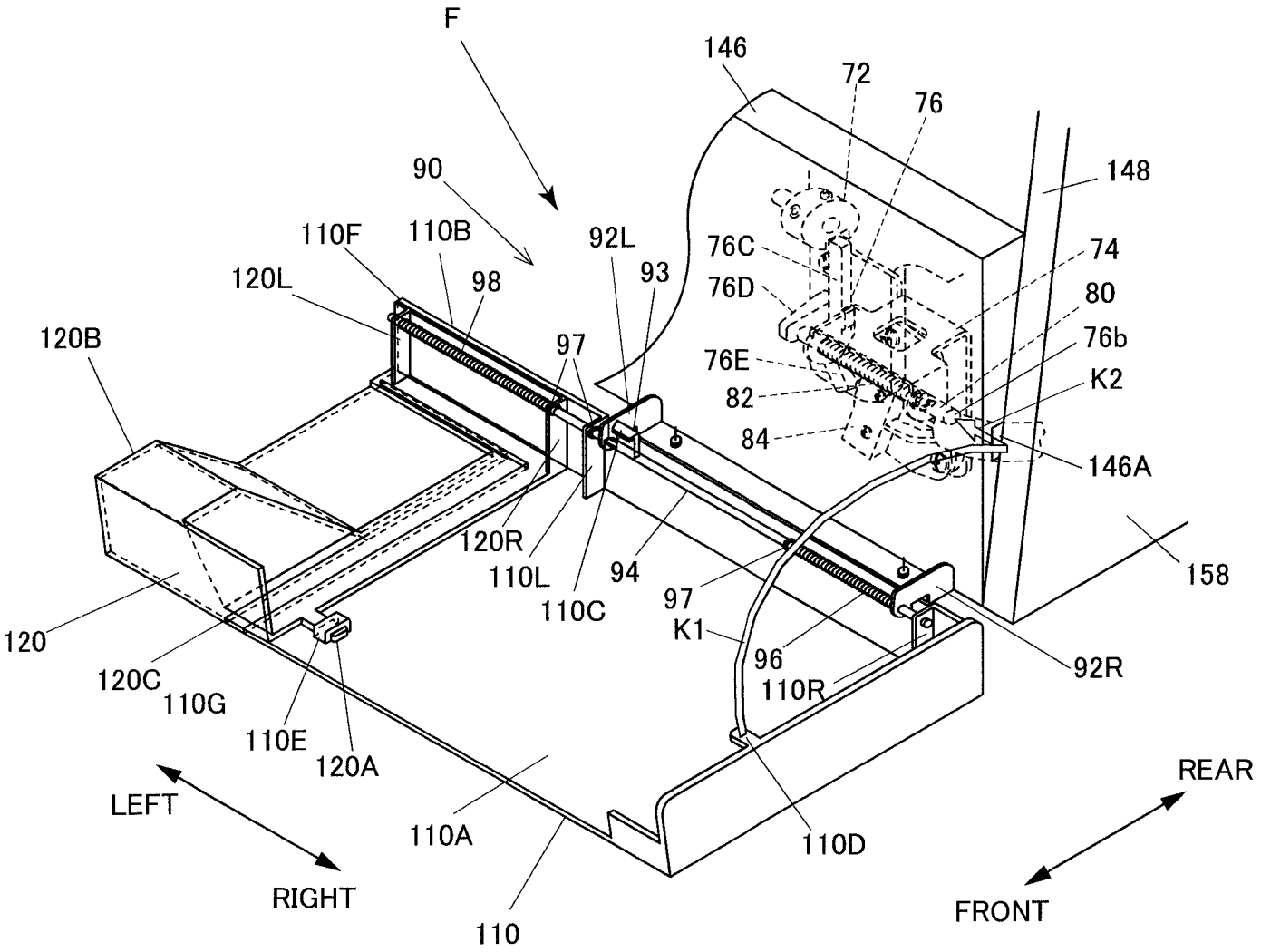
FIG. 6 is a perspective view showing the components around a looper cover and a hinge of a blade cover on the front side of the overlock sewing machine.
Figure 7:
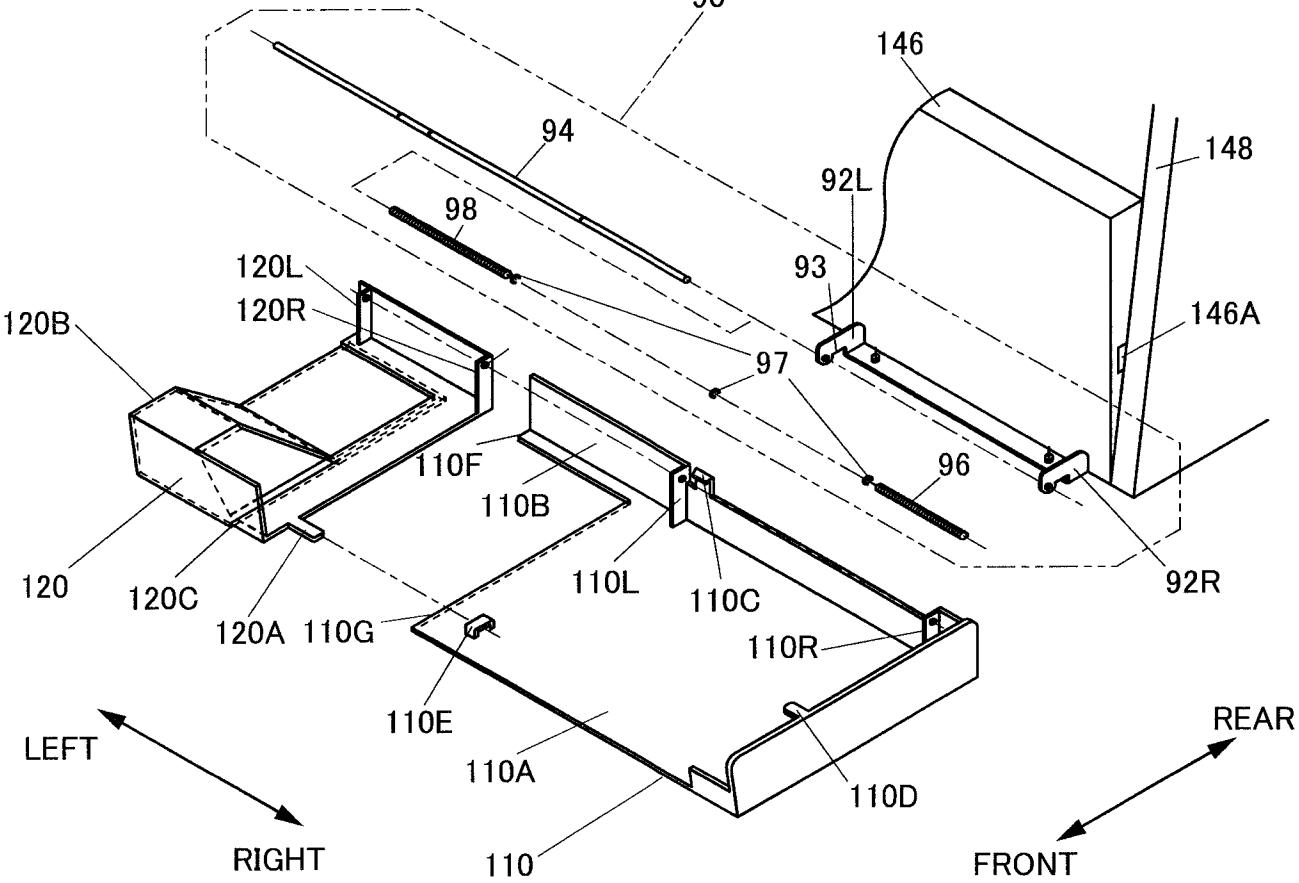
FIG. 7 is an exploded perspective view showing the configuration around the looper cover and the blade cover.

As shown in FIG. 11, the cover position switching mechanism F is configured including a hinge mechanism 90 that couples the looper cover 110 with the overlock sewing machine 1 via a hinge, and a side cover open/closed state detection shaft 100 (which will simply be referred to as the "cover detection shaft 100" hereafter). Also, as shown in FIGS. 6 and 7, the hinge mechanism 90 is configured including a pair of left and right fixed hinge portions 92L 92R arranged at the lower-end portion of the front cover 146 arranged on the front side of the overlock sewing machine 1, a hinge shaft 94 arranged such that its axis extends in the left-right direction (width direction), and a hinge spring 96 configured as a compression coil spring. It should be noted that the front cover 146 covers the threading switching mechanism C, the main shaft fixing mechanism D, and the safety mechanism E, described above, from the front side.

With this arrangement, the looper cover 110 is provided on the front side of the front cover 146 in order to cover a part of the aforementioned looper portion A. The looper cover 110 is configured such that it can be opened and closed with respect to the front cover 146 by the hinge mechanism 90. Furthermore, the looper cover 110 includes a cover portion 110A configured to cover the front cover 146. Furthermore, in the open state of the looper cover 110 (state shown in FIG. 6), the rear-end portion of the looper cover 110 has an extension that extends toward the left side with respect to the cover portion 110A. The extension will be referred to as an "extension portion 110B". In other words, the cover portion 110A is structured such that the left-side portion of the cover portion 110A is cut out. Furthermore, in the open state of the looper cover 110, a pair of left and right hinge portions 110L and 110R are provided on the rear-end portion of the looper cover 110. The hinge portions 110L and 110R are arranged on the right side with respect to the extension portion 110B such that there is a distance between them in the left-right direction.

In the hinge mechanism 90, the pair of left and right fixed hinge portions 92L and 92R are arranged such that there is a distance between them in the left-right direction, and such that they are arranged between the pair of hinge portions 110L and 110R of the looper cover 110. Furthermore, the hinge shaft 94 is slidably held by the pair of fixed hinge portions 92L and 92R. Furthermore, the pair of hinge portions 110L and 110R of the looper cover 110 are held by the hinge shaft 94 so as to be rotatable and slidable in the left-right direction. Moreover, a notch 93 is formed in the left-side fixed hinge portion 92L such that it has an opening facing the lower side. Moreover, the shaft length of the hinge shaft 94 is designed such that it corresponds to the left-right length of the rear-end portion of the looper cover 110 in the open state thereof. That is to say, the hinge shaft 94 is designed to have a shaft length that is larger than the length between the pair of hinge portions 110L and 110R. The hinge shaft 94 is arranged such that it extends toward the left side with respect to the hinge portion 110L.

The hinge spring (looper cover spring) 96 is mounted on (fitted to) the right-side portion of the hinge shaft 94. With such an arrangement, the hinge spring 96 is mounted in a state in which its shape is compressed and changed between an E-ring 97 engaged with the hinge shaft 94 on the left side of the fixed hinge portion 92R and the fixed hinge portion 92R. In this state, the hinge spring 96 applies a force to the hinge shaft 94 toward the left side. Furthermore, another E-ring 97 is engaged with the hinge shaft 94 on the right side of the hinge portion 110L of the looper cover 110. With this arrangement, the E-ring 97 is pressed in contact with the hinge portion 110L by the hinge shaft 94 pressed toward the left side, which applies a force to the looper cover 110 toward the left side.

Furthermore, a rib 110C monolithically provided to the looper cover 110 is arranged on the right side with respect to the fixed hinge portion 92L. With such an arrangement, in the open state of the looper cover 110, the rib 110C is in contact with the fixed hinge portion 92L, which restricts the movement of the looper cover 110 toward the left side. In contrast, in the closed state in which the looper cover 110 covers the front cover 146, the rib 110C is positioned on the right side of the notch 93 of the hinge portion 92L. In this state, the position restriction for the looper cover 110 provided by the rib 110C is disabled.

Furthermore, a hook (pressing portion) 110D is monolithically provided to the right-side wall of the looper cover 110. The hook 110D is configured such that it protrudes from the right-side wall toward the left side. With such an arrangement, upon turning the looper cover 110 from the open position of the looper cover 110 shown in FIG. 6 to the closed position side (arrow K1 side shown in FIG. 6), the looper cover 110 comes in contact with the front cover 146 or the belt cover 148, and reaches the closed position. Specifically, at the closed position, the hook 110D of the looper cover 110 is positioned adjacent to the right side with respect to a window 146A formed in the right wall of the front cover 146.

With such an arrangement, at the closed position of the looper cover 110, the looper cover 110 is slid toward the left side by the force applied by the hinge spring 96, and the rib 110C is inserted into the notch 93 of the hinge structure 90. Furthermore, the hook 110D of the looper cover 110 is inserted into the window 146A (see the arrow K2 shown in FIG. 9) such that it is engaged with the window 146A. In this state, this arrangement prevents the looper cover 110 from turning toward the front side and from coming to be in the open state. That is to say, with such an arrangement, the looper cover 110 is maintained at the closed position. In a state in which the side cover 130 is closed as described later, the right-side face of the looper cover 110 and a right-side face of the sewing machine main body cover 158 are positioned at a closed position so as to form a single face (this closed position of the looper cover 110 will be referred to as the "normal closed state" hereafter). Furthermore, when the looper cover 110 is slid toward the left side by the force applied by the hinge spring 96, the looper cover 110 is configured such that its hook 110D presses a right end 80A of the cover detection shaft 80 toward the left side.

The blade cover 120 is arranged on the left side of the looper cover 110 (specifically, the cover portion 110A). The blade cover 120 includes a pair of left and right hinge portions 120L and 120R to be coupled with the hinge shaft 94 via hinges. The hinge portions 120L and 120R are held by the hinge shaft 94 (the left-side portion thereof) so as to be rotatable and slidable in the left-right direction. That is to say, the hinge shaft 94 is configured as a common rotational shaft for the looper cover 110 and the blade cover 120.

Furthermore, a blade cover spring 98 configured as a compression coil spring is mounted on (fitted to) the left-side portion of the hinge shaft 94 such that it is interposed between the pair of hinge portions 120L and 120R of the blade cover 120. The right end of the blade cover spring 98 is engaged with the E-ring 97 fixed to the hinge shaft 94. The blade cover spring 98 applies a force to the blade cover 120 toward the left side.

Furthermore, a hook 120A is formed on the right-side portion of blade cover 120 such that it protrudes toward the right side. The hook 120A is inserted from the left side into an approximately U-shaped guide 110E formed in the left-side portion of the looper cover 110 so as to be slidable. With this arrangement, in a state in which the hook 120A is inserted into the guide 110E, the blade cover 120 is turned together with the looper cover 110 such that they cover a lower blade 150 and an upper blade 152 (see FIG. 11) from the front side. After the blade cover 120 is turned to the closed position together with the looper cover 110, the blade cover 120 is slid toward the left side along the hinge shaft 94. A left end 120B of the blade cover 120 comes in contact with the lower blade 150 or otherwise a support member for supporting the lower blade 150, thereby restricting the sliding of the blade cover 120 toward the left side.

Furthermore, a step portion 120C is formed in the blade cover 120 along the edge of the left-side portion (cut-out portion) of the looper cover 110. The step portion 120C is formed such that, in a state in which the hook 120A of the blade cover 120 is inserted into the guide 110E of the looper cover 110, the surface (front face in the closed state) of the blade cover 120 and the surface (front face) of the looper cover 110 form a single face.

Figure 8:
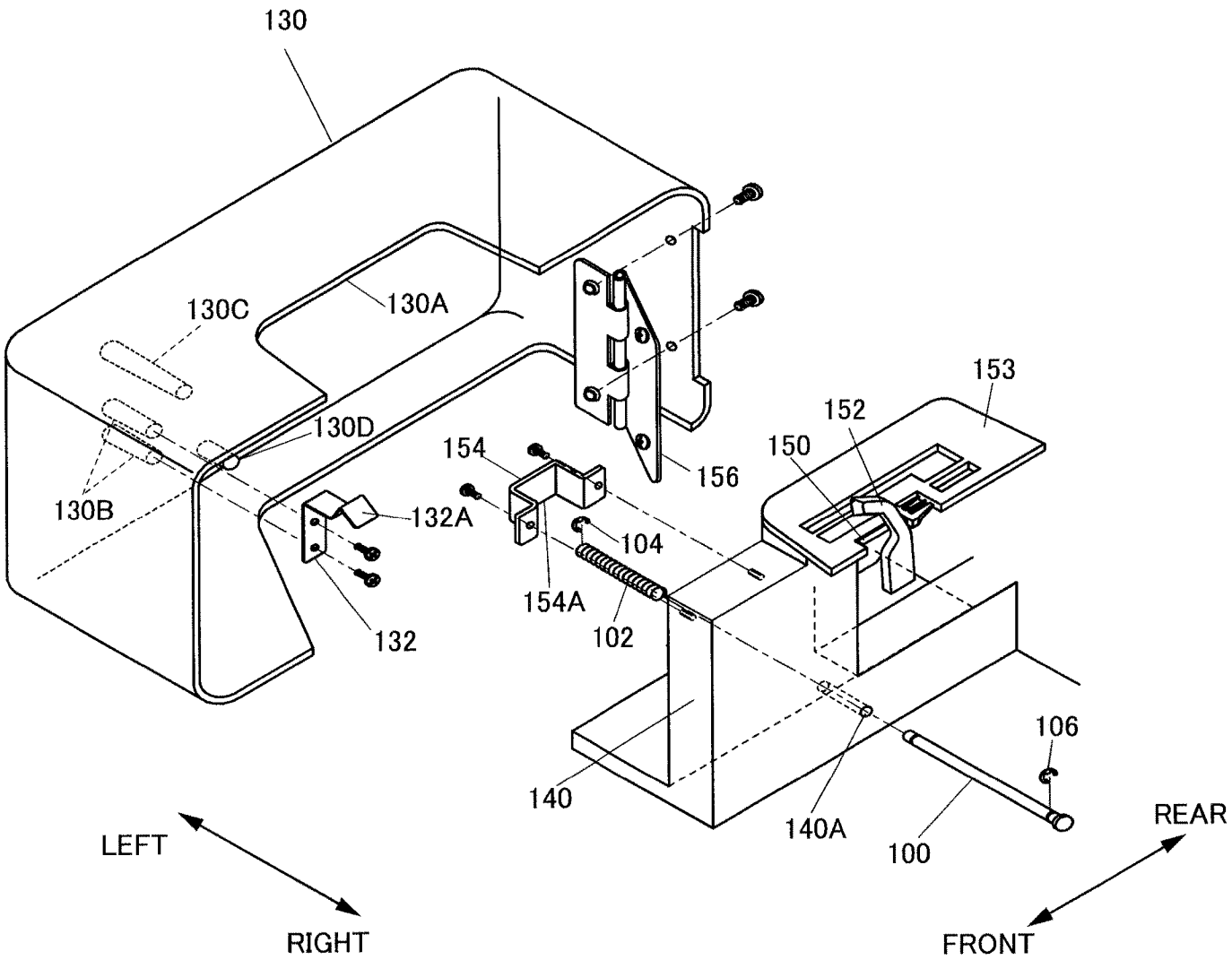
FIG. 8 is a component configuration diagram showing a side cover and a sewing machine main body portion that corresponds to the side cover on the front side of the overlock sewing machine.

As shown in FIG. 8, the cover detection shaft 100 is arranged such that it extends axially in the left-right direction. The cover detection shaft 100 is arranged on the left side of the hinge shaft 94 (see FIG. 11) such that they are coaxially arranged. Furthermore, the cover detection shaft 100 is inserted into a through hole 140A formed in the sewing machine main body 140 so as to be slidable. The cover detection shaft 100 is configured such that its right end comes in contact with the left end of the hinge shaft 94. The left-side portion of the cover detection shaft 100 is arranged such that it protrudes toward the left side with respect to the sewing machine main body 140. A detection spring 102 configured as a compression coil spring is mounted on the left-side portion of the cover detection shaft 100 (see FIG. 9). The detection spring 102 is arranged between an E-ring 104 engaged with the left-end portion of the cover detection shaft 100 and the sewing machine main body 140, and presses the cover detection shaft 100 toward the left side. Furthermore, an E-ring 106 is engaged with the right-end portion of the cover detection shaft 100. By engaging the E-ring 106 with the sewing machine main body 140, the position of the cover detection shaft 100 is maintained. The position of the cover detection shaft 100 in this state will be referred to as an "open-state detection position".

A reception plate 154 is provided on the left side of the sewing machine main body 140 such that it is arranged above the cover detection shaft 100. The reception plate 154 is formed in an approximately hat-shaped structure having an opening facing the right side as viewed in a plan view. Both ends of the reception plate 154 formed along its longitudinal direction are fixed to the sewing machine main body 140 by screws.

The side cover 130 is formed in an approximately box-shaped structure having an opening facing the right side. The side cover 130 is arranged on the left side with respect to the looper cover 110 (one of both sides of the hinge shaft 94 along its axial direction). The opening portion formed as the rear wall of the side cover 130 is fixed to the sewing machine main body 140 via a hinge member 156. Specifically, the side cover 130 is fixed to the sewing machine main body 140 such that it can be opened and closed with the upper-lower direction as the axial direction.

Furthermore, an opening portion is formed in the upper wall of the side cover 130, which is configured as a storage portion 130A having an opening facing the right side. With such an arrangement, a needle plate 153 of the sewing machine main body 140 is stored in the storage portion 130A. Furthermore, an engagement member 132 is fixed to the left-side wall of the side cover 130. The engagement member 132 is formed in an approximately inverted-L-shaped structure as viewed from the front side. The lower portion of the engagement member 132 is fixed to a pair of upper and lower fixing portions 130B formed in the side cover 130 by screws. Furthermore, a hook portion 132A is formed at an end of the upper-end side of the engagement member 132 such that it protrudes toward the upper side. With such an arrangement, when the side cover 130 is set to the closed state, the hook portion 132A is engaged with a lower face 154A of the reception plate 154, which maintains the closed state of the side cover 130.

Furthermore, an approximately cylindrical stopper 130C is formed on the left-side wall of the side cover 130 such that it is positioned above the fixing portions 130B. With such an arrangement, when the side cover 130 is closed, the stopper 130C comes in contact with the top wall of the reception plate 154, thereby restricting the turning of the side cover 130.

Figure 10:
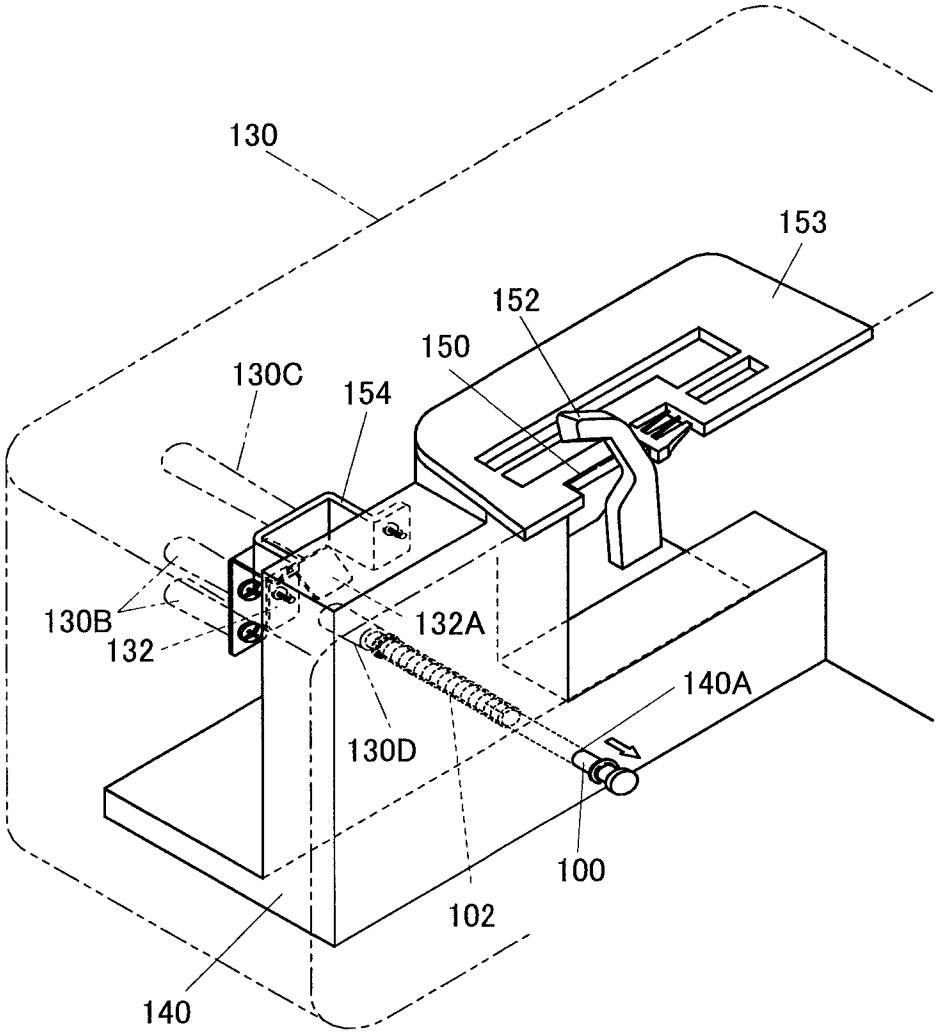
FIG. 10 is a perspective view showing the closed state of the side cover.

Furthermore, an approximately cylindrical detection shaft pressing portion 130D is formed on the left-side wall of the side cover 130 such that it protrudes. With such an arrangement, as shown in FIG. 9, in a state in which the side cover 130 is opened, the detection shaft pressing portion 130D retracts toward the left side away from the cover detection shaft 100, thereby setting the cover detection shaft 100 to an open-state detection position. In contrast, in a state as shown in FIG. 10 in which the side cover 130 is closed, the detection shaft pressing portion 130D presses the left end of the cover detection shaft 100 toward the right side (see the arrow in FIG. 10) against the force applied by the detection spring 102. As a result, the cover detection shaft 100 is positioned on the right side with respect to the open-state detection position (this position of the cover detection shaft 100 will be referred to as the "closed-state detection position" hereafter).

With such an arrangement, when the cover detection shaft 100 is set to the closed-state detection position, the right end of the cover detection shaft 100 comes in contact with the hinge shaft 94, and the looper cover 110 is set to the normal closed position. Moreover, when the looper cover 110 is set to the normal closed position, the hook 110D of the looper cover 110 presses the cover detection shaft 80 toward the left side such that the cover detection shaft 80 presses the operation arm 76D of the detection lever 76 by a predetermined amount toward the left side. That is to say, when the detection lever 76 is swung from the initial position to the operation-enabled position, the switch 84 is switched to the on state. In contrast, when the cover detection shaft 100 is set to the open-state detection position, the cover detection shaft 100 is positioned on the left side with respect to the closed-state detection position. Accordingly, in this state, the looper cover 110 and the hinge shaft 94 are positioned on the left side beyond the normal closed position (overrun position). Specifically, in this state, the pressing amount by which the cover detection shaft 80 has been pressed by the hook 110D of the looper cover 110 becomes larger than the predetermined amount, which swings the detection lever 76 from the initial position to the operation-disabled position.

When the cutoff width by which a cloth (sewing target) is to be cut off by a lower blade 150 and an upper blade 152 (that correspond to a "cutting mechanism" in the present disclosure) is set to its minimum value, the blade cover 120 is pressed by the force applied by the blade cover spring 98 such that it approaches the left side (see the arrow M1 in FIG. 11). Specifically, in this state, the position of the left end face 110F of the looper cover 110 matches the position of the left end 120B of the blade cover 120 in the left-right direction. In this state, a gap is formed between the step portion 120C of the blade cover 120 and the left-end face 110G of the cover portion 110A. The gap is designed to have an appropriate margin with respect to the movement amounts of the upper and lower blades in the left-right direction accompanying the adjustment of the cloth cutoff amount.

Figure 12:
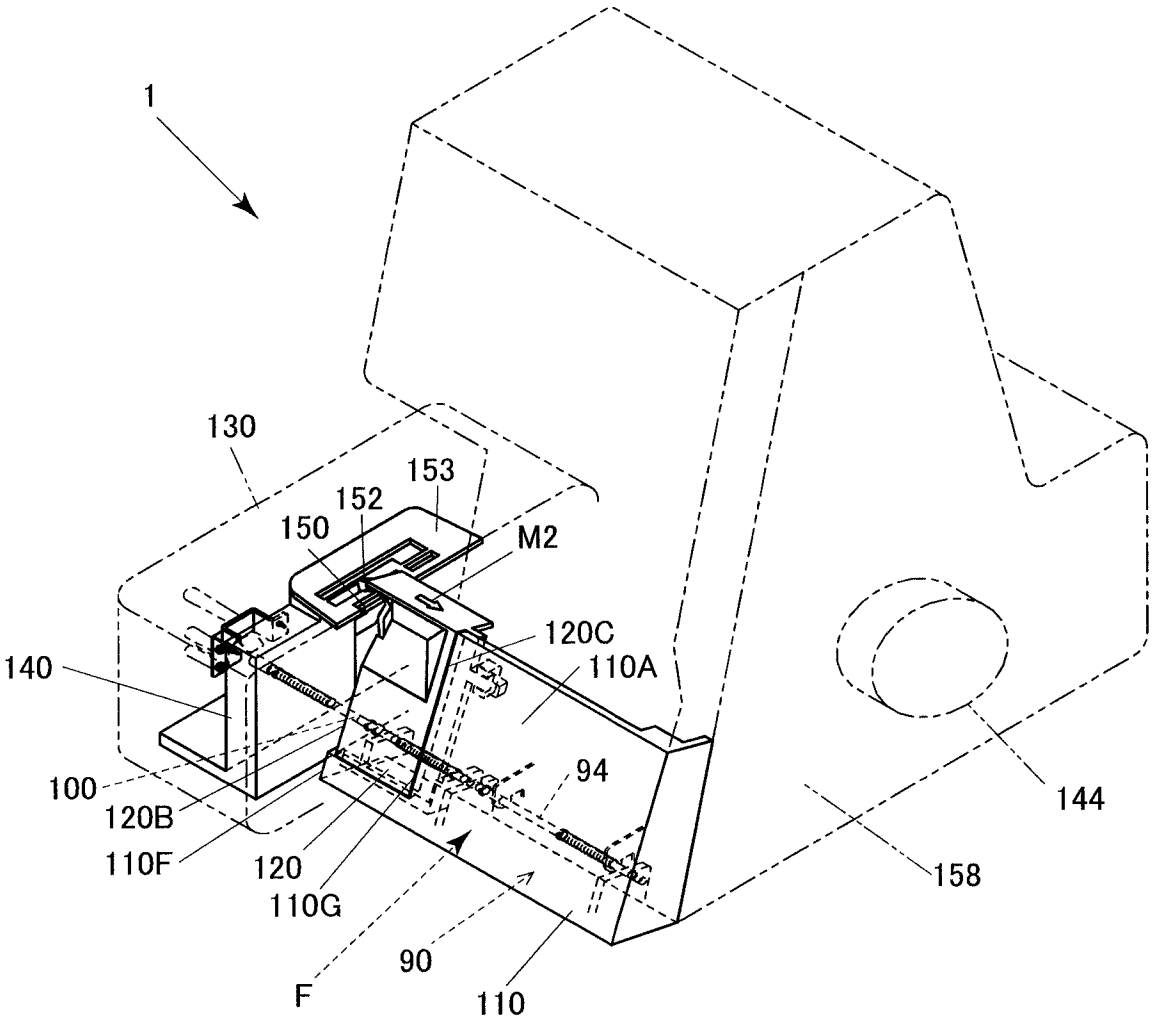
FIG. 12 is a diagram showing a state in which the cloth cutoff width to be set for the blades is set to its maximum.

In contrast, as shown in FIG. 12, when the cutoff width by which a cloth is to be cut off by the lower blade 150 and the upper blade 152 is set to its maximum, the left end 120B of the blade cover 120 is moved toward the right side (see the arrow M2 in FIG. 12) according to the movement of the upper and lower blades, and a level difference occurs between the left end 120B of the blade cover 120 and the left-end face 110F of the looper cover 110. Furthermore, the gap between the step portion 120C of the blade cover 120 and the left-end face 110G of the cover portion 110A becomes smaller according to the amount of movement of the blade cover 120 as compared with the state shown in FIG. 11. It should be noted that, in order to provide an improved design, a box-shaped member such as a scrap cloth box or the like may be provided as an additional component in order to cover the aforementioned level difference and gap.

[Operations and Effects]

Next, description will be made with reference to the table shown in FIG. 13 regarding the operations and effects of the present embodiment. FIG. 13 is a table showing the states of the principal components of the overlock sewing machine 1 in each of four kinds of states of the overlock sewing machine 1 (states S1 through S4). In this table, in each column shown in FIG. 13, the states of the principal components of the overlock sewing machine 1 are classified into the following items.

In the first column, the states (threading state and sewing-enabled state) of the threading switching mechanism C are shown in a front view.

In the second column, the fitting states of the main shaft fixing plate 69 and the outer-side fixing shaft 60 (operation-enabled state and operation-disabled state of the main shaft 68) are shown.

In the third column, the positions of the judgment ring (operation-enabled state and operation-disabled state of the detection lever 76) are shown.

In the fourth column, the open state and the closed state of the looper cover 110 are shown.

In the fifth column, the open state and the closed state of the side cover 130 are shown.

In the sixth column, the operation states of the switch 84 are shown.

In the seventh column, the states (disconnection state and conduction state) of the power supply for a motor of the overlock sewing machine 1 are shown.

[Regarding State S1]

Referring to the row showing the state S1 in FIG. 13, in the state S1, the switching knob 54 is turned in the counterclockwise direction as viewed from the front side, which sets the threading switching mechanism C to the threading state.

That is to say, with the threading switching mechanism C, when the switching knob 54 is turned in the counterclockwise direction, the switching linkage member 48 is turned around the axis of the support shaft 46 together with the switching knob 54. In this stage, the engagement arm 48D of the switching linkage member 48 is engaged with the engagement pin 40A of the switching member 40, and the switching member 40 is turned in the clockwise direction around the axis of the operation shaft 38. In this operation, the switching operation member 42 is turned around the axis of the operation shaft 38 together with the switching member 40. The outer-side fixing shaft 60 is moved toward the back side by the coupling pin 66 coupled to the switching operation member 42.

Subsequently, when the notch 69A of the main shaft fixing plate 69 matches the position of the outer-side fixing shaft 60 after the flywheel 144 is rotated, the outer-side fixing shaft 60 is inserted into the notch 69A of the main shaft fixing plate 69 by the force applied by the operation spring 44, and the outer-side fixing shaft 60 is fitted into the notch 69A. As a result, the main shaft 68 is set to the rotation-disabled state. It should be noted that, in the state S1, the edge of the slot 24C1 of the slide plate 24 is inserted into the groove portion 60B of the outer-side fixing shaft 60. As a result, the slide plate 24 and the pair of slide tubes 22 are slid to the threading position.

Furthermore, in this state, the judgment ring 72 of the safety mechanism E is turned in the clockwise direction around the axis of the operation shaft 38 together with the switching member 40 such that the opening of the notch 72A of the judgment ring 72 faces a diagonally lower-front side. That is to say, the notch 72A is displaced in the circumferential direction of the operation shaft 38 from the position that matches the first lever portion 76C of the detection lever 76. In this state, the detection lever 76 is set to the operation restricted state.

Accordingly, in the state S1, the detection lever 76 is not able to rotate, and accordingly, the detection lever 76 is maintained at the initial position. That is to say, the second lever portion 76E of the detection lever 76 is maintained at a position at which it does not press the operation protrusion 84A of the switch 84. Accordingly, in the state S1, this arrangement maintains a state in which the switch 84 is turned off and the motor power supply is disconnected regardless of whether or not the looper cover 110 or the side cover 130 is opened or closed.

[Regarding State S2]

Referring to the row showing the state S2 in FIG. 13, in the state S2, the switching knob 54 is turned in the clockwise direction so as to set the threading switching mechanism C to the sewing-enabled state.

That is to say, when the switching knob 54 is turned in the clockwise direction, the switching linkage member 48 is turned around the axis of the support shaft 46 together with the switching knob 54. In this stage, the engagement arm 48C of the switching linkage member 48 is engaged with the engagement pin 40A of the switching member 40, which turns the switching member 40 around the axis of the operation shaft 38 in the counterclockwise direction. In this operation, the switching operation member 42 is turned around the axis of the operation shaft 38 together with the switching member 40. As a result, the coupling pin 66 that is coupled with the switching operation member 42 is moved toward the front side.

Furthermore, when the switching linkage member 48 is turned, the switching arm 48B of the switching linkage member 48 presses the pin 24D of the slide plate 24 toward the right side, which slides the slide plate 24 toward the right side. As a result, the outer-side fixing shaft 60 is positioned within the expanded-diameter portion 24C2 of the slide plate 24. Subsequently, the coupling pin 66 is moved toward the front side, which moves the outer-side fixing shaft 60 toward the front side. In this state, the rear end 60C of the outer-side fixing shaft 60 is moved toward the front side away from the main shaft fixing plate 69. That is to say, the fitting state of the outer-side fixing shaft 60 and the notch 69A is released. As a result, the rotation of the main shaft 68 is enabled.

Furthermore, in this state, the judgment ring 72 of the safety mechanism E is turned in the counterclockwise direction around the axis of the operation shaft 38 together with the switching member 40 such that the opening of the notch 72A faces the lower side. In other words, the notch 72A is moved in the circumferential direction of the operation shaft 38 such that its position matches the first lever portion 76C of the detection lever 76. In this state, the detection lever 76 is able to turn around the axis of the support shaft 74A (the detection lever 76 is set to the operation-enabled state).

However, in the state S2, the looper cover 110 is opened. Accordingly, the right end 80A of the cover detection shaft 80 cannot be pressed toward the left side by the hook 110D of the looper cover 110. This maintains the detection lever 76 in the non-operating state, and maintains the detection lever 76 at the initial position. Accordingly, in the state S2, the switch 84 is set to the off state and the motor power supply is disconnected as in the state S1 regardless of whether the side cover 130 is opened or closed.

[Regarding State S3]

Referring to the row showing the state S3 in FIG. 13, in the state S3, the threading switching mechanism C is set to the sewing-enabled state as in the state S2. That is to say, the main shaft 68 is set to the rotation-enabled state, and the detection lever 76 is set to the operation-enabled state.

Furthermore, in the state S3, the looper cover 110 is closed. That is to say, in the closed state of the looper cover 110, the looper cover 110 is slid toward the left side by the force applied by the hinge spring 96. Furthermore, the hook 110D of the looper cover 110 is inserted into the window 146A of the front cover 146. As a result, the hook 110D presses the right end 80A of the cover detection shaft 80 toward the left side so as to slide the cover detection shaft 80 toward the left side against the force applied by the force-applying spring 82.

However, in the state S3, the side cover 130 is opened. Accordingly, the detection shaft pressing portion 130D of the side cover 130 is positioned on the left side away from the left end of the cover detection shaft 100. That is to say, the cover detection shaft 100 is positioned at the open-state detection position. In this state, the hinge shaft 94 and the looper cover 110 are positioned closer to the left side beyond the normal closed position. That is to say, when the hook 110D of the looper cover 110 presses the right end 80A of the cover detection shaft 80 toward the left side, the cover detection shaft 80 is excessively pressed toward the left side by the hook 110D. As a result, in the operation of the detection lever 76, the first lever portion 76C of the detection lever 76 passes the operation protrusion 84A of the switch 84 (passes through the operation-enabled state), and is positioned at the operation-disabled position. Accordingly, in the state S3, the switch 84 temporarily comes to be in the on state. However, immediately after the on state, the switch 84 is switched to the off state, thereby disconnecting the motor power supply.

[Regarding State S4]

Referring to the row showing the state S4 in FIG. 13, in the state S4, the threading switching mechanism C is set to the sewing-enabled state as in the states S2 and S3. That is to say, the main shaft 68 is set to the rotation-enabled state, and the detection lever 76 is set to the operation-enabled state.

Furthermore, in the state S4, the side cover 130 and the looper cover 110 are each closed. That is to say, the detection shaft pressing portion 130D of the side cover 130 presses the left end of the cover detection shaft 100 toward the right side, and the cover detection shaft 100 is positioned at the closed-state detection position. Accordingly, the hinge shaft 94 and the looper cover 110 are positioned at the normal closed position. That is to say, at this position, when the hook 110D of the looper cover 110 presses the right end 80A of the cover detection shaft 80 toward the left side, the cover detection shaft 80 is pressed by the hook 110D toward the left side by the predetermined amount. As a result, in the state S4, the detection lever 76 is turned to the operation-enabled position at which the first lever portion 76C presses the operation protrusion 84A of the switch 84. Accordingly, the switch 84 comes to be in the on state, thereby setting the motor power supply to the conduction state.

As described above, with the overlock sewing machine 1 according to the present embodiment, when the switching mechanism (threading switching mechanism C) is switched to the sewing-enabled state, the detection lever 76 is set to the operation-enabled state. That is to say, when the switching mechanism (threading switching mechanism C) is set to the threading state, the detection lever 76 is set to the non-operating state, and the detection lever 76 is maintained at the initial position at which it does not press the operation protrusion 84A of the switch 84. This arrangement provides a function of detecting the switching of the switching mechanism between the sewing-enabled state and the threading state using only the single switch 84.

Furthermore, when the looper cover 110 is set to the closed position, the looper cover 110 is slid toward the left side (one direction in the axial direction of the hinge shaft 94), and the detection lever 76 operates. When the detection lever 76 operates at a position at which the side cover 130 is closed, the detection lever 76 is positioned at the operation-enabled position at which the detection lever 76 presses the operation protrusion 84A of the switch 84. In contrast, when the detection lever 76 operates at a position at which the side cover 130 is opened, the detection lever 76 transits (passes) through the operation-enabled position, and is positioned at the operation-disabled position at which it does not press the operation protrusion 84A of the switch 84. With such an operation described above, when both the looper cover 110 and the side cover 130 are closed, the switch 84 is set to the on state, thereby setting the motor power supply to the conduction state. This arrangement requires only the single switch 84 to detect whether the two covers, i.e., the looper cover 110 and the side cover 130, are each opened or closed.

Furthermore, the cover position switching mechanism F of the overlock sewing machine 1 includes the cover detection shaft 100. With such an arrangement, in a state in which the side cover 130 is closed, the cover detection shaft 100 is set to the closed-state detection position, which restricts the position of the looper cover 110 such that it is maintained at the normal closed position. That is to say, the position of the looper cover 110 at the closed position is restricted such that the pressing amount by which the detection lever 76 is pressed by the cover detection shaft 80 matches the predetermined amount. In contrast, when the side cover 130 is opened, the cover detection shaft 100 is set to the open-state detection position, and the looper cover 110 is positioned closer to the left side beyond the normal closed position. That is to say, the positioning restriction of the looper cover 110 at the normal closed position is released such that the pressing amount by which the detection lever 76 is pressed by the cover detection shaft 80 becomes larger than the predetermined amount. As described above, the cover detection shaft 100 functions as a member that sets or releases the positioning restriction of the looper cover 110 (hook 110D) along the left-right direction in the closed state according to the open/closed state of the side cover 130. This arrangement requires only a simple configuration to detect the open/closed state of the side cover 130.

When the looper cover 110 is turned to the closed position, the hinge shaft 94 and the looper cover 110 to which a force is applied by the hinge spring 96 are slid toward the left side against the force applied by the force-applying spring 82 that applies a force to the cover detection shaft 80 and against the force applied by the detection lever spring 78 that applies a force to the detection lever 76. With this arrangement, when the user turns the looper cover 110 from the open position to the closed position, this arrangement is capable of automatically sliding the looper cover 110 to the normal closed position side. Thus, this arrangement provides improved convenience for the user.

Furthermore, when the threading switching mechanism C is set to the sewing-enabled state, the judgment ring 72 is positioned at an enabled position at which operation of the detection lever 76 is enabled. In contrast, when the threading switching mechanism C is set to the threading state, the judgment ring 72 is turned (swung) to a position at which the operation of the detection lever 76 is restricted (disabled). With this arrangement, in the threading state of the threading switching mechanism C, this arrangement is capable of preventing the detection lever 76 from operating and of preventing the motor power supply from coming to be in the conduction state even if the user inadvertently closes the looper cover 110.

Furthermore, in the safety mechanism E, the switch 84 is fixed to the unit base 142 via the cover detection base 74. In other words, the switch 84 is fixed to a member that does not move even when the looper cover 110 or the side cover 130 is opened or closed. This arrangement suppresses the movement of the wiring member connected to the switch 84 even when the looper cover 110 or the side cover 130 is opened or closed, thereby suppressing the occurrence of damage to the wiring member. Furthermore, the switch 84 is covered by the front cover 146 from the front side, thereby suppressing inadvertent touching of the wiring member by the user.

Furthermore, the looper cover 110 and the blade cover 120 are each configured as a separate unit. The blade cover 120 is configured so as to be slidable in the left-right direction independent of the looper cover 110. With this arrangement, the position of the looper cover 110 is not affected by the position of the blade cover 120 even when the blade cover 120 is moved in the left-right direction according to the cutoff width adjustment value set for the lower blade 150 and the upper blade 152.

That is to say, in a case in which the looper cover 110 and the blade cover 120 are monolithically configured as a single unit, the position of the looper cover 110 is changed along the left-right direction according to the cutoff width adjustment amount set for the lower blade 150 and the upper blade 152. This leads to a change in the pressing amount by which the cover detection shaft 80 is pressed by the hook 110D of the looper cover 110. This leads to a situation in which the operation of the switch 84 is unstable.

In contrast, with the present embodiment, the looper cover 110 and the blade cover 120 are each configured as a separate unit. Accordingly, even when the blade cover 120 is displaced toward the left or right side according to the cutoff width adjustment amount set for the lower blade 150 and the upper blade 152, this operation has no effect on the operation of the looper cover 110 and the operation of the side cover 130. Thus, the operation of the switch 84 is not affected.

It should be noted that the cover position switching mechanism F is configured including the cover detection shaft 100. Also, in the cover position switching mechanism F, the cover detection shaft 100 may be omitted. In this case, the hinge shaft 94 may be configured such that it extends further toward the left side as compared with the present embodiment such that, when the side cover 130 is closed, the hinge shaft 94 or the left end of the looper cover 110 is directly pressed by the side cover 130 (detection shaft pressing portion 130D) so as to position the hinge shaft 94 and the looper cover 110 to the normal closed position.

Description has been made in the present embodiment regarding an arrangement in which the hook 110D is monolithically formed together with the looper cover 110 in the form of a single unit. Also, the hook 110D and the looper cover 110 may each be formed as a separate unit, and the hook 110D may be fixed to the looper cover 110.

Description has been made in the present embodiment regarding an arrangement in which the hinge spring 96 is configured as a compression coil spring. Also, the hinge spring 96 may be configured as another kind of spring. For example, the hinge spring 96 may be configured as an extension coil spring.

Description has been made in the present embodiment regarding an arrangement in which the switch 84 is fixed to the unit base 142 via the cover detection base 74. However, the member used to fix the switch 84 is not restricted to such an arrangement. For example, in a case in which the sewing machine main body 140 is stationary even when the looper cover 110 or the side cover 130 is opened or closed, the switch 84 may be fixed to the sewing machine main body 140.

DESCRIPTION OF THE REFERENCE NUMERALS

1 overlock sewing machine, 10 upper looper, 10A upper looper inlet, 10B upper looper blade tip, 12 lower looper 12A lower looper inlet, 12B lower looper blade tip, 14 looper balance, 14A upper looper thread hook, 14B lower looper thread hook, 16 main body, 16A upper looper thread insertion opening, 16B lower looper thread insertion opening, 16C upper looper thread discharging tube, 16D lower looper thread discharging tube, 18 selection knob, 19 tube, 20 tube support member, 20A, 20B support hole, 22 slide tube, 22A flange, 24 slide plate, 24L holding portion, 24A U-shaped groove, 24B slot, 24C irregularly shaped slot, 24C1 slot portion, 24C2 expanded-diameter portion, 24D pin, 26 slide tube spring, 28 support shaft, 30 shaft spring, 32 upper looper conducting tube, 34 lower looper conducting tube, 36 slide plate support, 36P pin, 36A, 36B through hole, 36C slot, 36D small hole, 38 operation shaft, 40 switching member, 40A engagement pin, 40P pin, 42 switching operation member, 42A engagement slot, 42P pin, 44 operation spring, 46 support shaft, 48 switching linkage member, 48A boss, 48B switching arm, 48C engagement arm, 48D engagement arm, 50 reception member, 52 E-ring, 54 switching knob, 56 looper balance guide, 56A, 56B round hole, 60 outer-side fixing shaft, 60A slot, 60B groove portion, 60C rear end, 62 inner-side fixing shaft, 64 shaft spring, 66 coupling pin, 68 main shaft, 69 main shaft fixing plate, 69A notch, 72 judgment ring, 72A notch, 74A cover detection base, 74A support shaft, 74B arm, 74C through hole, 76 detection lever, 76A support hole, 76B boss, 76C first lever portion, 76D operation arm, 76E second lever portion, 76F stopper, 78 detection lever spring, 80 looper cover open/closed state detection shaft, 80A right end, 82 force-applying spring (cover detection shaft spring), 83 E-ring, 84 switch, 84A operation protrusion, 86 switch base, 90 hinge mechanism, 92L, 92R fixed hinge portion, 93 notch, 94 hinge shaft, 96 hinge spring (looper cover spring), 97 E-ring, 98 blade cover spring, 100 side cover open/closed state detection shaft, 102 detection spring, 104, 106 E-ring, 110 looper cover, 110A cover portion, 110B extension portion, 110L hinge portion, 110R hinge portion, 110C rib, 110D hook (pressing portion), 110E guide, 110F left end face, 110G left end face, 120 blade cover, 120L hinge portion, 120R hinge portion, 120A hook, 120B left end, 120C step portion, 130 side cover, 130A storage portion, 130B fixing portion, 130C stopper, 130D detection shaft pressing portion, 132 engagement member, 132A hook portion, 140 sewing machine main body, 140A through hole, 142 unit base, 142A insertion hole, 144 flywheel, 146 front face cover, 146A window, 148 belt cover, 150 lower blade, 152 upper blade, 153 needle plate, 154 reception plate, 154A lower face, 156 hinge member, 158 sewing machine main body cover, A looper unit, B air flow path switching mechanism, C threading switching mechanism, D main shaft fixing mechanism, E safety mechanism, F cover position switching mechanism, TH1 upper looper thread, TH2 lower looper thread.

What is claimed is:

1. An overlock sewing machine comprising:

a threading mechanism that performs threading for a looper;

a switching mechanism that switches the threading mechanism between a threading state and a sewing-enabled state;

a looper cover coupled with a hinge shaft extending in a width direction on a front side of the threading mechanism such that it can be opened and closed, and configured to cover at least a part of the looper at a closed position;

a side cover provided on one side along the hinge shaft with respect to the looper cover, and coupled with a sewing machine main body such that it can be opened and closed;

a switch configured including an operation protrusion, and configured such that, when the operation protrusion is pressed, a motor configured to drive a main shaft is switched from a driving-disabled state to a driving-enabled state; and a detection lever configured to press the operation protrusion, and configured such that, when the switching mechanism is switched to the sewing-enabled state in a state in which the looper cover is positioned at a closed state, the looper cover is slid toward one side in an axial direction of the hinge shaft, which operates the detection lever, wherein, in a non-operation state, the detection lever is positioned at an initial position at which it does not press the operation protrusion, wherein the side cover is configured:

when the detection lever is operated in a state in which the side cover is set to a closed position, the detection lever is set to an operation-enabled position at which the detection lever presses the operation protrusion; and when the detection lever is operated in a state in which the side cover is set to an open position, the detection lever is set by passing through the operation-enabled position to an operation-disabled position at which the detection lever does not press the operation protrusion.

2. The overlock sewing machine according to claim 1, comprising:

a looper cover open/closed state detection shaft configured such that it extends in a direction in parallel with the hinge shaft, and such that, when it is moved toward one side along the hinge axis, it comes in contact with the detection lever so as to operate the detection lever; and a pressing portion provided to the looper cover, and configured such that, when the looper cover is slid toward the one side along the axial direction of the hinge shaft in a state in which the looper cover is set to the closed position, the pressing portion presses the looper cover open/closed state detection shaft, wherein, when the detection lever is operated in a state in which the side cover is set to the closed position, the side cover directly or otherwise indirectly operates the looper cover so as to provide positioning restriction of the pressing portion such that the detection lever is maintained at the operation-enabled position, and wherein, when the detection lever is operated in a state in which the side cover is set to the open position, the side cover is located away from the looper cover such that the positioning restriction of the pressing portion is released, thereby setting the detection lever to the operation-disabled position.

3. The overlock sewing machine according to claim 2, comprising:

a detection lever spring that applies a force to the detection lever such that it is set to the initial position from the operation-enabled position or otherwise the operation-disabled position;

a cover detection shaft spring that applies a force to the looper cover open/closed state detection shaft toward the other side in the axial direction; and a looper cover spring that applies a force to the looper cover such that the looper cover is moved toward the one side in the axial direction of the hinge shaft against the force applied by the cover detection shaft spring and the force applied by the detection lever spring in a state in which the looper cover is set to the closed position, so as to move the detection lever from the initial position to the operation-enabled position or otherwise to the operation-disabled position.

4. The overlock sewing machine according to claim 1, comprising:

a swing lever portion configured to be swingable in a predetermined range such that, when rotation of the main shaft is enabled, the swing lever portion is positioned at an enabled position in a stationary state, and when the rotation of the main shaft is disabled, the swing lever portion is set to a swing position displaced from the enabled position; and an operation restricting portion configured such that, when the swing lever portion is set to the enabled position, the operation of the detection lever is enabled, and such that, when the swing lever portion is not set to the enabled position, the operation of the detection lever is restricted.

5. The overlock sewing machine according to claim 1, wherein the switch is fixed to a sewing machine main body.

6. The overlock sewing machine according to claim 1, further comprising a blade cover provided together with the looper cover such that the blade cover can be opened and closed, and configured to cover at least a part of a cutting mechanism configured to cut a sewing target, wherein the blade cover is configured such that it can be moved in a direction along the axial direction of the hinge shaft independent of the looper cover according to a cutoff width adjustment amount set for the cutting mechanism.

* * * * *